US006946038B2

(12) United States Patent
Jeong et al.

(10) Patent No.: US 6,946,038 B2
(45) Date of Patent: Sep. 20, 2005

(54) STEEL PLATE HAVING TIN+MNS PRECIPITATES FOR WELDED STRUCTURES, METHOD FOR MANUFACTURING SAME AND WELDED STRUCTURE

(75) Inventors: Hong-Chul Jeong, Pohang-si (KR); Hae-Chang Choi, Pohang-si (KR); Wung-Yong Choo, Pohang-si (KR)

(73) Assignee: Posco (KR)

( * ) Notice: Subject to any disclaimer, the term of this patent is extended or adjusted under 35 U.S.C. 154(b) by 80 days.

(21) Appl. No.: 10/182,365

(22) PCT Filed: Nov. 20, 2001

(86) PCT No.: PCT/KR01/01985

§ 371 (c)(1),
(2), (4) Date: Jul. 26, 2002

(87) PCT Pub. No.: WO02/44436

PCT Pub. Date: Jun. 6, 2002

(65) Prior Publication Data

US 2003/0106623 A1 Jun. 12, 2003

(30) Foreign Application Priority Data

Dec. 1, 2000 (KR) ..... 2000-72238
Dec. 4, 2000 (KR) ..... 2000-72845

(51) Int. Cl.[7] ..... C22C 38/04; C22C 38/12; C22C 38/14; C21D 8/00; C23C 8/26

(52) U.S. Cl. ..... 148/330; 148/333; 148/334; 148/335; 148/328; 148/318; 148/654; 148/232

(58) Field of Search ..... 420/121, 126, 420/128; 148/226, 228, 231, 232, 654, 328, 333–336; 428/627, 684, 682; 228/26.41

(56) References Cited

U.S. PATENT DOCUMENTS 3,904,447 A * 9/1975 Gondo et al. ..... 148/506
4,494,999 A * 1/1985 Graf ..... 148/541
5,695,576 A * 12/1997 Beguinot ..... 148/328
5,743,972 A * 4/1998 Kimura et al. ..... 148/330
5,858,130 A * 1/1999 Bodnar et al. ..... 148/332
5,882,447 A * 3/1999 Kimura et al. ..... 148/654
5,900,075 A * 5/1999 Koo et al. ..... 148/328
6,686,061 B2 * 2/2004 Jeong et al. ..... 428/684

FOREIGN PATENT DOCUMENTS

JP 52-017314 A 2/1977
JP 58-031065 A 2/1983
JP 60-245768 A 12/1985
JP 61-079745 A 4/1986
JP 64-015320 A 1/1989
JP 01-176016 A 7/1989
JP 02-125812 A 5/1990
JP 05-186848 A 7/1993
JP 07-076751 A 3/1995
JP 08-060292 A 3/1996
JP 09-194990 A 7/1997
JP 09-324238 A 12/1997
JP 10-298706 A 11/1998
JP 10-298708 A 11/1998
JP 11-140582 A 5/1999
JP 11-293382 A 10/1999
JP 2000-226633 A 8/2000

OTHER PUBLICATIONS

Nakanishi, Mutsuo et al., "Improvement of Welded HAZ Toughness by Dispersion with Nitride Particles and Oxide Particles", *Journal of Japanese Welding Society*, vol. 52, No. 2, p. 49 (1983).

* cited by examiner

*Primary Examiner*—Deborah Yee
(74) *Attorney, Agent, or Firm*—Webb Ziesenheim Logsdon Orkin & Hanson, P.C.

(57) ABSTRACT

A weldable structural steel product having fine complex precipitates of TiN and MnS is provided which contains, in terms of percent by weight, 0.03 to 0.17% C, 0.01 to 0.05% Si, 1.0 to 2.5% Mn, 0.05 to 0.2% Ti, 0.0005 to 0.1% Al, 0.008 to 0.030% N, 0.0003 to 0.01% B, 0.001 to 0.2% W, at most 0.03% P, 0.003 to 0.05% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, $6.5 \leqq (Ti+2Al+4B)/N \leqq 14$, and $220 \leqq Mn/S \leqq 400$. The steel has a microstructure consisting essentially of a complex structure of ferrite and pearlite having a grain size of 20 $\mu$m or less.

19 Claims, No Drawings

STEEL PLATE HAVING TIN+MNS PRECIPITATES FOR WELDED STRUCTURES, METHOD FOR MANUFACTURING SAME AND WELDED STRUCTURE

BACKGROUND OF THE INVENTION

1. Field of the Invention

The present invention relates to a structural steel product suitable fo use in constructions, bridges, ship constructions, marine structures, steel pipes, line pipes, etc. More particularly, the present invention relates to a weldable structural steel product which is manufactured using fine complex precipitates of TiN and MnS, dispersed in such a fashion that MnS surrounds TiN, thereby being capable of simultaneously exhibiting improved toughness and strength in a heat-affected zone. The present invention also relates to a method for manufacturing the weldable structural steel product, and a welded construction using the welded structural steel product.

2. Description of the Prior Art

Recently, as the height or size of buildings and other structures has increased, steel products having an increased size have been increasingly used. That is, thick steel products have been increasingly used. In order to weld such thick steel products, it is necessary to use a welding process with a high efficiency. For welding techniques for thick steel products, a heat-input submerged welding process enabling a single pass welding, and an electro-welding process have been widely used. The heat-input welding process enabling a single pass welding is also applied to ship constructions and bridges requiring welding of steel plates having a thickness of 25 mm or more. Generally, it is possible to reduce the number of welding passes at a higher amount of heat input because the amount of welded metal deposited is increased. Accordingly, there may be an advantage in terms of welding efficiency where the heat-input welding process is applicable. That is, in the case of a welding process using an increased heat input, its application can be widened. Typically, the heat input used in welding is in the range of 100 to 200 kJ/cm. In order to weld steel plates further thickened to a thickness of 50 mm or more, it is necessary to use super-high heat input ranging from 200 kJ/cm to 500 kJ/cm.

Where high heat input is applied to a steel product, the heat affected zone, in particular, its portion arranged near a fusion boundary, is heated to a temperature approximate to a melting point of the steel product by welding heat input. As a result, growth of grains occurs at the heat affected zone, so that a coarsened grain structure is formed. Furthermore, when the steel product is subjected to a cooling process, fine structures having degraded toughness, such as bainite and martensite, may be formed. Thus, the heat affected zone may be a site exhibiting degraded toughness.

In order to secure a desired stability of such a welding structure, it is necessary to suppress the growth of austenite grains at the heat affected zone, so as to allow the welding structure to maintain a fine structure. Known as means for meeting this requirement are techniques in which oxides stable at a high temperature or Ti-based carbon nitrides are appropriately dispersed in steels in order to delay growth of grains at the heat affected zone during a welding process. Such techniques are disclosed in Japanese Patent Laid-open Publication No. Hei. 12-226633, Hei. 11-140582, Hei. 10-298708, Hei. 10-298706, Hei. 9-194990, Hei. 9-324238, Hei. 8-60292, Sho. 60-245768, Hei. 5-186848, Sho. 58-31065, Sho. 61-79745, and Sho. 64-15320, and Journal of Japanese Welding Society, Vol. 52, No. 2, pp 49.

The technique disclosed in Japanese Patent Laid-open Publication No. Hei. 11-140582 is a representative one of techniques using precipitates of TiN. This technique has proposed structural steels exhibiting an impact toughness of about 200 J at 0° C. (in the case of a matrix, about 300 J). In accordance with this technique, the ratio of Ti/N is controlled to be 4 to 12, so as to form TiN precipitates having a grain size of 0.05 $\mu$m or less at a density of $5.8\times10^3/mm^2$ to $8.1\times10^4/mm^2$ while forming TiN precipitates having a grain size of 0.03 to 0.2 $\mu$m at a density of $3.9\times10^3/mm^2$ to $6.2\times10^4/mm^2$, thereby securing a desired toughness at the welding site. In accordance with this technique, however, both the matrix and the heat affected zone exhibit substantially low toughness where a heat-input welding process is applied. For example, the matrix and heat affected zone exhibit impact toughness of 320 J and 220 J at 0° C. Furthermore, since there is a considerable toughness difference between the matrix and heat affected zone, as much as about 100 J, it is difficult to secure a desired reliability for a steel construction obtained by subjecting thickened steel products to a welding process using super-high heat input. Moreover, in order to obtain desired TiN precipitates, the technique involves a process of heating a slab at a temperature of 1,050° C. or more, quenching the heated slab, and again heating the quenched slab for a subsequent hot rolling process. Due to such a double heat treatment, an increase in the manufacturing costs occurs.

Japanese Patent Laid-Qpen Publication No. Hei. 9-194990 discloses a technique in which the ratio between Al and O in low steel ($N\leqq0.005\%$) is controlled to be within a range of 0.3 to 1.5 ($0.3\leqq Al/O\leqq1.5$) in order to form a complex oxide containing Al, Mn, and Si. However, the steel product according to this technique exhibits a degraded toughness because when a welding process using a high heat input of about 100 kJ/cm, the transition temperature at the heat affected zone corresponds to a level of about −50. Also, Japanese Patent Laid-open Publication No. Hei. 10-298708 discloses a technique in which complex precipitates of MgO and TiN are utilized. However, the steel product according to this technique exhibits a degraded toughness in that when a welding process uses a high heat input of about 100 kJ/cm, the impact toughness at 0° C. in the heat affected zone corresponds to 130 J.

There have been many techniques for improving the toughness of the heat affected zone using TiN precipitates and Al-based oxides or MgO where a welding process using a high heat input is applied. However, there is no technique capable of remarkably improving the toughness of the heat affected zone where a welding process using a super-high heat input is carried out for a prolonged period of time at 1,350° C. or more.

SUMMARY OF THE INVENTION

Therefore, it is an object of the invention to provide a welded structural steel product in which complex precipitates of TiN and MnS are dispersed in such a fashion that MnS surround TiN precipitates, thereby being capable of improving both the toughness and strength (or hardness) of the heat affected zone while minimizing the toughness difference between the matrix and the heat affected zone, a method for manufacturing the welded structural steel product, and a welded structure using the welded structural steel product.

In accordance with one aspect, the present invention provides a welding welded structural steel product having fine complex precipitates of TiN and MnS, comprising, in terms of percent by weight, 0.03 to 0.17% C, 0.01 to 0.5% Si, 1.0 to 2.5% Mn, 0.005 to 0.2% Ti, 0.0005 to 0.1% Al, 0.008 to 0.030% N, 0.0003 to 0.01% B, 0.001 to 0.2% W, at most 0.03% P, 0.003 to 0.05% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, $6.5 \leqq (Ti+2Al+4B)/N \leqq 14$, and $200 \leqq Mn/S \leqq 400$, and having a microstructure essentially consisting of a complex structure of ferrite and pearlite having a grain size of 20 $\mu$m or less.

In accordance with another aspect, the present invention provides a method for manufacturing a welded structural steel product having fine complex precipitates of TiN and MnS, comprising the steps of:

preparing a steel slab containing, in terms of percent by weight, 0.03 to 0.17% C, 0.01 to 0.5% Si, 1.0 to 2.5% Mn, 0.005 to 0.2% Ti, 0.0005 to 0.1% Al, 0.008 to 0.030% N, 0.0003 to 0.01% B, 0.001 to 0.2% W, at most 0.03% P, 0.003 to 0.05% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, $6.5 \leqq (Ti+2Al+4B)/N \leqq 14$, and $200 \leqq Mn/S \leqq 400$;

heating the steel slab at, a temperature ranging from 1,000° C. to 1,250° C. for 60 to 180 minutes;

hot rolling the heated steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

In accordance with another aspect, the present invention provides a method for manufacturing a welded structural steel product having fine complex precipitates of TiN and MnS, comprising the steps of:

preparing a steel slab containing, in terms of percent by weight, 0.03 to 0.17% C, 0.01 to 0.5% Si, 1.0 to 2.5% Mn, 0.005 to 0.2% Ti, 0.0005 to 0.1% Al, at most 0.005 N, 0.0003 to 0.01% B, 0.001 to 0.2% W, at most 0.03% P, 0.003 to 0.05% S, at most 0.005% O, and balance Fe and incidental impurities while satisfying a condition of $200 \leqq Mn/S \leqq 400$;

heating the steel slab at a temperature ranging from 1,000° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$;

hot rolling the nitrogenized steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

In accordance with another aspect, the present invention provides a welded structure having a superior heat affected zone toughness, manufactured using any one of the above described welded structural steel products.

DETAILED DESCRIPTION OF THE INVENTION

Now, the present invention will be described in detail.

In the specification, the term "prior austenite" represents an austenite formed at the heat affected zone in a steel product (matrix) when a welding process using high heat input is applied to the steel product. This austenite is distinguished from the austenite formed in the manufacturing procedure (hot rolling process).

After carefully observing the growth behavior of the prior austenite in the heat affected zone in a steel product (matrix) and the phase transformation of the prior austenite exhibited during a cooling procedure when a welding process using high heat input is applied to the steel product, the inventors found that the heat affected zone exhibits a variation in toughness with reference to the critical grain size of the prior austenite (about 80 $\mu$m), and that the toughness at the heat affected zone is increased at an increased fraction of fine ferrite.

On the basis of such an observation, the present invention is characterized by:

[1] utilizing complex precipitates of TiN and MnS in the steel product;

[2] reducing the grain size of initial ferrite in the steel product (matrix) to a critical level or less so as to control the prior austenite to have a grain size of about 80 $\mu$m or less; and

[3] reducing the ratio of Ti/N to effectively form BN and AlN precipitates, thereby increasing the fraction of ferrite at the heat affected zone, while controlling the ferrite to have a acicular or polygonal structure effective to achieve an improvement in toughness.

The above features [1], [2], [3] of the present invention will be described in detail.

[1] Complex Precipitates of TiN and MnS

Where a high heat-input welding is applied to a structural steel product, the heat affected zone near a fusion boundary is heated to a high temperature of about 1,400° C. or more. As a result, TiN precipitated in the matrix is partially dissolved due to the weld heat. Otherwise, an Ostwald ripening phenomenon occurs. That is, precipitates having a small grain size are dissolved, so that they are diffused in the form of precipitates having a larger grain size. In accordance with the Ostwald ripening phenomenon, a part of the precipitates are coarsened. Furthermore, the density of TiN precipitates is considerably reduced, so that the effect of suppressing growth of prior austenite grains disappears.

After observing a variation in the characteristics of TiN precipitates depending on the ratio of Ti/N while taking into consideration the fact that the above phenomenon may be caused by diffusion of Ti atoms occurring when TiN precipitates dispersed in the matrix are dissolved by the welding heat, the inventors discovered the new fact that under a high nitrogen concentration condition (that is, a low Ti/N ratio), the concentration and diffusion rate of dissolved Ti atoms are reduced, and an improved high-temperature stability of TiN precipitates is obtained. That is, when the ratio between Ti and N (Ti/N) ranges from 1.2 to 2.5, the amount of dissolved Ti is greatly reduced, thereby causing TiN precipitates to have an increased high-temperature stability. As a result, fine TiN precipitates are uniformly dispersed at a high density. Such a surprising result was assumed to be based on the fact that the solubility product representing the high-temperature stability of TiN precipitates is reduced at a reduced content of nitrogen, because when the content of nitrogen is increased under the condition in which the content of Ti is constant, all dissolved Ti atoms are easily coupled with nitrogen atoms, and the amount of dissolved Ti is reduced under a high nitrogen concentration condition.

Also, the inventors noticed that if re-dissolution of TiN precipitates distributed in the heat affected zone near the fusion boundary can be prevented even when those TiN precipitates in the matrix are fine while being uniformly dispersed, it is possible to easily suppress growth of prior austenite grains. That is, the inventors researched a scheme for delaying the re-dissolution of TiN precipitates in a matrix. As a result of this research, the inventors found that where TiN is distributed in the heat affected zone in the form of complex precipitates of TiN and MnS in such a fashion that MnS surrounds TiN precipitates in the matrix, re-dissolution of those TiN precipitates into the matrix is considerably delayed even when the TiN precipitates are heated to a high temperature of 1,350° C. That is, MnS, which is preferentially re-dissolved, surrounds TiN, so that it influences the dissolution of TiN and the re-dissolution rate of TiN into the matrix. As a result, TiN effectively contributes to suppressing growth of prior austenite grains. Thus, a remarkable improvement in the toughness of the heat affected zone is achieved.

Accordingly, it is important to reduce the solubility product representing the high-temperature stability of TiN precipitates while uniformly dispersing fine complex precipitates of TiN and MnS in the matrix. After observing variations in the size, amount, and density of complex precipitates of TiN and MnS depending on the ratios of Ti and N (Ti/N) and of Mn and S (Mn/S), the inventors found that complex precipitates of TiN and MnS having a grain size of 0.01 to 0.1 $\mu$m are precipitated at a density of $1.0\times10^7/mm^2$ or more under the condition in which the ratio of Ti/N is 1.2 to 2.5, and the ratio of Mn/S is 220 to 400. That is, the precipitates had a uniform space of about 0.5 $\mu$m.

The inventors also discovered an interesting fact. That is, even when a high-nitrogen steel is manufactured by producing, from a steel slab, a low-nitrogen steel having a nitrogen content of 0.005% or less to exhibit a low possibility of generation of slab surface cracks, and then subjecting the low-nitrogen steel to a nitrogen zing treatment in a slab heating furnace, it is possible to obtain desired TiN precipitates as defined above, in so far as the ratio of Ti/N is controlled to be 1.2 to 2.5. This was analyzed to be based on the fact that when an increase in nitrogen content is made in accordance with a nitrogen zing treatment under the condition in which the content of Ti is constant, all dissolved Ti atoms are easily rendered to be coupled with nitrogen atoms, thereby reducing the solubility product of TiN representing the high-temperature stability of TiN precipitates.

In accordance with the present invention, in addition to the control of the ratio of Ti/N, respective ratios of N/B, Al/N, and V/N, the content of N, and the total content of Ti+Al+B+(V) are generally controlled to precipitate N in the form of BN, AlN, and VN, taking into consideration the fact that promoted aging may occur due to the presence of dissolved N under a high-nitrogen environment. In accordance with the present invention, as described above, the toughness difference between the matrix and the heat affected zone is minimized by not only controlling the density of TiN precipitates depending on the ratio of Ti/N and the solubility product of TiN, but also dispersing TiN in the form of complex precipitates of TiN and MnS in which MnS appropriately surrounds TiN precipitates. This scheme is considerably different from the conventional precipitate control scheme (Japanese Patent Laid-open Publication No. Hei. 11-140582) in which the amount of TiN precipitates is increased by simply increasing the content of Ti ($Ti/N \geqq 4$).

[2] Control for Ferrite Grain Size of Steels (Matrix)

After research, the inventors found that in order to control prior austenite to have a grain size of about 80 $\mu$m or less, it is important to form fine ferrite grains in a complex structure of ferrite and pearlite, in addition to control of precipitates. Fining of ferrite grains can be achieved by fining austenite grains in accordance with a hot rolling process or controlling growth of ferrite grains occurring during, a cooling process following the hot rolling process. In this connection, it was also found that it is very effective to appropriately precipitate carbides (VC and WC) effective to growth of ferrite grains at a desired density.

[3] Microstructure of Heat Affected Zone

The inventors also found that the toughness of the heat affected zone is considerably influenced by not only the size of prior austenite grains, but also the amount and shape of ferrite precipitated at the grain boundary of the prior austenite when the matrix is heated to a temperature of 1,400° C. In particular, it is preferable to generate a transformation of polygonal ferrite or acicular ferrite in austenite grains. For this transformation, AlN and BN precipitates are utilized in accordance with the present invention.

The present invention will now be described in conjunction with respective components of a steel product to be manufactured, and a manufacturing method for the steel product.

Weldable Structural Steel Product

First, the composition of the weldable structural steel product according to the present invention will be described.

In accordance with the present invention, the content of carbon (C) is limited to a range of 0.03 to 0.17weight % (hereinafter, simply referred to as "%").

Where the content of carbon (C) is less than 0.03%, it is impossible to secure a sufficient strength for structural steels. On the other hand, where the C content exceeds 0.17%, transformation of weak-toughness microstructures such as upper bainite, martensite, and degenerate pearlite occurs during a cooling process, thereby causing the structural steel product to exhibit a degraded low-temperature impact toughness. Also, an increase in the hardness or strength of the welding site occurs, thereby causing a degradation in toughness and generation of welding cracks.

The content of silicon (Si) is limited to a range of 0.01 to 0.5%.

At a silicon content of less than 0.01%, it is impossible to obtain a sufficient deoxidizing effect of molten steel in the steel manufacturing process. In this case, the steel product also exhibits a degraded corrosion resistance. On the other hand, where the silicon content exceeds 0.5%, a saturated deoxidizing effect is exhibited. Also, transformation of island-like martensite is promoted due to an increase in hardenability occurring in a cooling process following a rolling process. As a result, a degradation in low-temperature impact toughness occurs.

The content of manganese (Mn) is limited to a range of 1.0 to 2.5%.

Mn has an effective function for improving the deoxidizing effect, weldability, hot workability, and strength of steels. This element is precipitated in the form of MnS around Ti-based oxides, so that it promotes generation of acicular and polygonal ferrite effective to improve the toughness of the heat affected zone. The Mn element forms a substitutional solid solution in a matrix, thereby solid-solution strengthening the matrix to secure desired strength and toughness. In order to obtain such effects, it is desirable for Mn to be contained in the composition in a content of 1.0% or more. However, where the Mn content exceeds 2.5%, macroscopic segregation and microscopic segregation occur in accordance with a segregation mechanism in a solidification procedure of steels, thereby promoting formation of a central segregation band in the matrix in a rolling process. Such a central segregation band serves as a cause for forming a central low-temperature transformed structure in the matrix.

The content of titanium (Ti) is limited to a range of 0.005 to 0.2%.

Ti is an essential element in the present invention because it is coupled with N to form fine TiN precipitates stable at a high temperature. In order to obtain such an effect of precipitating fine TiN grains, it is desirable to add Ti in an amount of 0.005% or more. However, where the Ti content exceeds 0.2%, coarse TiN precipitates and Ti oxides may be formed in molten steel. In this case, it is impossible to suppress the growth of prior austenite grains in the heat affected zone.

The content of aluminum (Al) is limited to a range of 0.0005 to 0.1%.

Al is an element which is not only necessarily used as a deoxidizer, but also serves to form fine AlN precipitates in steels. Al also reacts with oxygen to form an Al oxide, thereby preventing Ti from reacting with oxygen. Thus, Al aids Ti to form fine TiN precipitates. For such functions, Al is preferably added in an amount of 0.0005% or more. However, when the content of Al exceeds 0.1%, dissolved Al remaining after precipitation of AlN promotes formation of Widmanstatten ferrite and island-like martensite exhibiting weak toughness in the heat affected zone in a cooling process. As a result, a degradation in the toughness of the heat affected zone occurs where a high heat input welding process is applied.

The content of nitrogen (N) is limited to a range of 0.008 to 0.03%.

N is an element essentially required to form TiN, AlN, BN, VN, NbN, etc. N serves to suppress, as much as possible, the growth of prior austenite grains in the heat affected zone when a high heat input welding process is carried out, while increasing the amount of precipitates such as TiN, AlN, BN, VN, NbN, etc. The lower limit of N content is determined to be 0.008% because N considerably affects the grain size, space, and density of TiN and AlN precipitates, the frequency of those precipitates to form complex precipitates with oxides, and the high-temperature stability of those precipitates. However, when the N content exceeds 0.03%, such effects are saturated. In this case, a degradation in toughness occurs due to an increased amount of dissolved nitrogen in the heat affected zone. Furthermore, the surplus N may be included in the welding metal in accordance with a dilution occurring in the welding process, thereby causing a degradation in the toughness of the welding metal.

Meanwhile, the slab used in accordance with the present invention may be low-nitrogen steels which may be subsequently subjected to a nitrogen zing treatment to form high-nitrogen steels. In this case, the slab has a N content of 0.0005% in order to exhibit a low possibility of generation of slab surface cracks. The slab is then subjected to a re-heating process involving a nitrogen zing treatment, so as to manufacture high-nitrogen steels having an N content of 0.008 to 0.03%.

The content of boron (B) is limited to a range of 0.0003 to 0.01%.

B is an element which is very effective to form acicular ferrite exhibiting a superior toughness in grain boundaries while forming polygonal ferrites in the grain boundaries. B forms BN precipitates, thereby suppressing the growth of prior austenite grains. Also, B forms Fe boron carbides in grain boundaries and within grains, thereby promoting transformation into acicular and polygonal ferrites exhibiting a superior toughness. It is impossible to expect such effects when the B content is less than 0.0003%. On the other hand, when the B content exceeds 0.01%, an increase in hardenability may undesirably occur, so that there may be possibilities of hardening the heat affected zone, and generating low-temperature cracks.

The content of tungsten (W) is limited to a range of 0.001 to 0.2%.

When tungsten is subjected to a hot rolling process, it is uniformly precipitated in the form of tungsten carbides (WC) in the matrix, thereby effectively suppressing growth of ferrite grains after ferrite transformation. Tungsten also serves to suppress the growth of prior austenite grains at the initial stage of a heating process for the heat affected zone. Where the tungsten content is less than 0.001%, the tungsten carbides serving to suppress the growth of ferrite grains during a cooling process following the hot rolling process are dispersed at an insufficient density. On the other hand, where the tungsten content exceeds 0.2%, the effect of tungsten is saturated.

The content of phosphorous (P) is limited to 0.030% or less.

Since P is an impurity element causing central segregation in a rolling process and formation of high-temperature cracks in a welding process, it is desirable to control the content of P to be as low as possible. In order to achieve an improvement in the toughness of the heat affected zone and a reduction in central segregation, it is desirable for the P content to be 0.03% or less.

The content of sulfur (S) is limited to a range of 0.003 to 0.005%.

S is an element which is precipitated around Ti-based oxides in the form of MnS, so that it influences the formation of ferrites having an acicular or polygonal structure effective to achieve an improvement in the toughness of the heat affected zone. For such effects, S is preferably added in an amount of 0.003% or more. However, when the content of S exceeds 0.05%, a low-melting point compound such as FeS may be formed, which has a possibility of promoting high-temperature welding cracks. Accordingly, the S content is not to be more than 0.05%.

The content of oxygen (O) is limited to 0.005% or less.

Where the content of O exceeds 0.005%, Ti forms Ti oxides in molten steels, so that it cannot form TiN precipitates. Accordingly, it is undesirable for the O content to be more than 0.005%. Furthermore, inclusions such as coarse Fe oxides and Al oxides may be formed which undesirably affect the toughness of the matrix.

In accordance with the present invention, the ratio of Ti/N is limited to a range of 1.2 to 2.5.

When the ratio of Ti/N is limited to a desired range as defined above, there are two advantages as follows.

First, it is possible to increase the density of TiN precipitates while uniformly dispersing those TiN precipitates. That is, when the nitrogen content is increased under the condition in which the Ti content is constant, all dissolved Ti atoms are easily coupled with nitrogen atoms in a continuous casting process (in the case of a high-nitrogen slab) or in a cooling process following a nitrogen zinc treatment (in the case of a low-nitrogen slab), so that fine TiN precipitates are formed while being dispersed at an increased density.

Second, the solubility product of TiN representing the high-temperature stability of TiN precipitates is reduced, thereby preventing a re-dissolution of Ti. That is, Ti predominantly exhibits a property of coupling with N under a high-nitrogen environment, over a dissolution property.

Accordingly, TiN precipitates are stable at a high temperature.

Therefore, the ratio of Ti/N is controlled to be 1.2 to 2.5 in accordance with the present invention. When the Ti/N ratio is less than 1.2, the amount of nitrogen dissolved in the matrix is increased, thereby degrading the toughness of the heat affected zone. On the other hand, when the Ti/N ratio is more than 2.5, coarse TiN grains are formed. In this case, it is difficult to obtain a uniform dispersion of TiN. Furthermore, the surplus Ti remaining without being precipitated in the form of TiN is present in a dissolved state, so that it may adversely affect the toughness of the heat affected zone.

The ratio of N/B is limited to a range of 10 to 40.

When the ratio of N/B is less than 10, BN serving to promote a transformation into polygonal ferrites at the grain boundaries of prior austenite is precipitated in an insufficient amount in the cooling process following the welding process. On the other hand, when the N/B ratio exceeds 40, the effect of BN is saturated. In this case, an increase in the amount of dissolved nitrogen occurs, thereby degrading the toughness of the heat affected zone.

The ratio of Al/N is limited to a range of 2.5 to 7.

Where the ratio of Al/N is less than 2.5, AlN precipitates for causing a transformation into acicular ferrites are dispersed at an insufficient density. Furthermore, an increase in the amount of dissolved nitrogen in the heat affected zone occurs, thereby possibly causing formation of welding cracks. On the other hand, where the Al/N ratio exceeds 7, the effects obtained by controlling the Al/N ratio are saturated.

The ratio of (Ti+2Al+4B)/N is limited to a range of 6.5 to 14.

Where the ratio of (Ti+2Al+4B)/N is less than 6.5, the grain size and density of TiN, AlN, BN, and VN precipitates are insufficient, so that it is impossible to achieve suppression of the growth of prior austenite grains in the heat affected zone, formation of fine polygonal ferrite at grain boundaries, control of the amount of dissolved nitrogen, formation of acicular ferrite and polygonal ferrite within grains, and control of structure fractions. On the other hand, when the ratio of (Ti+2Al+4B)/N exceeds 14, the effects obtained by controlling the ratio of (Ti+2Al+4B)/N are saturated. Where V is added, it is preferable for the ratio of (Ti+2Al+4B+V)/N to range from 7 to 17.

The ratio of Mn/S is limited to a range of 220 to 400.

In accordance with the present invention, precipitates of MnS are formed at the boundaries between TiN precipitates and matrix. Accordingly, when these precipitates are heated to a high temperature, they are preferentially dissolved again in the matrix, thereby increasing the re-dissolution temperature, as compared to TiN precipitates dispersed alone, or delaying the time required for re-dissolution.

The ratio of Mn/S should be 220 or more in order to obtain an appropriate amount of complex precipitates of TiN and MnS for desired control of the growth of austenite grains in the heat affected zone. However, when the ratio of Mn/S exceeds 400, MnS precipitates surrounding TiN precipitates are coarsened, so that the effects obtained by controlling the ratio of Mn/S are saturated. Furthermore, an increase in the hardenability of the heat affected zone may occur, thereby causing a degradation in toughness while promoting formation of high-temperature cracks in the welding metal.

In accordance with the present invention, V may also be selectively added to the above defined steel composition.

V is an element which is coupled with N to form VN, thereby promoting formation of ferrite in the heat affected zone. VN is precipitated alone, or precipitated in TiN precipitates, so that it promotes a ferrite transformation. Also, V is coupled with C, thereby forming a carbide, that is, VC. This VC serves to suppress growth of ferrite grains after the ferrite transformation.

Thus, V further improves the toughness of the matrix and the toughness of the heat affected zone. In accordance with the present invention, the content of V is preferably limited to a range of 0.01 to 0.2%. Where the content of V is less than 0.01%, the amount of precipitated VN is insufficient to obtain an effect of promoting the ferrite transformation in the heat affected zone. On the other hand, where the content of V exceeds 0.2%, both the toughness of the matrix and the toughness of the heat affected zone are degraded. In this case, an increase in welding hardenability occurs. For this reason, there is a possibility of formation of undesirable low-temperature welding cracks.

Where V is added, the ratio of V/N is preferably controlled to be 0.3 to 9.

When the ratio of V/N is less than 0.3, it may be difficult to secure an appropriate density and grain size of VN precipitates dispersed at boundaries of complex precipitates of TiN and MnS for an improvement in the toughness of the heat affected zone. On the other hand, when the ratio of V/N exceeds 9, the VN precipitates dispersed at the boundaries of complex precipitates of TiN and MnS may be coarsened, thereby reducing the density of those VN precipitates. As a result, the fraction of ferrite effectively serving to improve the toughness of the heat affected zone may be reduced.

In order to further improve mechanical properties, the steels having the above defined composition may be added with one or more element selected from the group consisting of Ni, Cu, Nb, Mo, and Cr in accordance with the present invention.

The content of Ni is preferably limited to a range of 0.1 to 3.0%.

Ni is an element which is effective to improve the strength and toughness of the matrix in accordance with a solid-solution strengthening. In order to obtain such an effect, the Ni content is preferably 0.1% or more. However, when the Ni content exceeds 3.0%, an increase in hardenability occurs, thereby degrading the toughness of the heat affected zone. Furthermore, there is a possibility of formation of high-temperature cracks in both the heat affected zone and the matrix.

The content of copper (Cu) is limited to a range of 0.1 to 1.5%.

Cu is an element which is dissolved in the matrix, thereby solid-solution strengthening the matrix. That is, Cu is effective to secure desired strength and toughness for the matrix. In order to obtain such an effect, Cu should be added in a content of 0.1% or more. However, when the Cu content exceeds 1.5%, the hardenability of the heat affected zone is increased, thereby causing a degradation in toughness. Furthermore, formation of high-temperature cracks at the heat affected zone and welding metal is promoted. In particular, Cu is precipitated in the form of CuS around Ti-based oxides, along with S, thereby influencing the formation of ferrites having an acicular or polygonal structure effective to achieve an improvement in the toughness of the heat affected zone. Accordingly, it is preferred for the Cu content to be 0.1 to 1.5%.

In the case where Cu and Ni are added together in the present invention, it is preferable to limit the sum of the addition to a range of 3.5% or less. When the contents exceed 3.5%, the toughness of the heat affected zone and weldability could be aggravated.

The content of Nb is preferably limited to a range of 0.01 to 0.10%.

Nb is an element which is effective to secure a desired strength of the matrix. For such an effect, Nb is added in an amount of 0.01% or more. However, when the content of Nb exceeds 0.1%, coarse NbC may be precipitated alone, adversely affecting the toughness of the matrix.

The content of chromium (Cr) is preferably limited to a range of 0.05 to 1.0%.

Cr serves to increase hardenability while improving strength. At a Cr content of less than 0.05%, it is impossible to obtain desired strength. On the other hand, when the Cr content exceeds 1.0%, a degradation in toughness in both the matrix and the heat affected zone occurs.

The content of molybdenum (Mo) is preferably limited to a range of 0.05 to 1.0%.

Mo is an element which increases hardenability while improving strength. In order to secure desired strength, it is necessary to add Mo in an amount of 0.05% or more. However, the upper limit of the Mo content is determined to be 1.0%, similar to Cr, in order to suppress hardening of the heat affected zone and formation of low-temperature welding cracks.

In accordance with the present invention, one or both of Ca and REM may also be added in order to suppress the growth of prior austenite grains in a heating process.

Ca and REM serve to form an oxide exhibiting a superior high-temperature stability, thereby suppressing the growth of prior austenite grains in the matrix during a heating process while improving the toughness of the heat affected zone. Also, Ca has an effect of controlling the shape of coarse MnS in a steel manufacturing process. For such effects, Ca is preferably added in an amount of 0.0005% or more, whereas REM is preferably added in an amount of 0.005% or more. However, when the Ca content exceeds 0.005%, or the REM content exceeds 0.05%, large-size inclusions and clusters are formed, thereby degrading the cleanness of steels. For REM, one or more of Ce, La, Y, and Hf may be used.

Now, the microstructure of the weldable structural steel product according to the present invention will be described.

Preferably, the microstructure of the steel product according to the present invention obtained after being subjected to a hot rolling process is a complex structure of ferrite and pearlite. Also, the ferrite should have a grain size of 20 $\mu$m or less. Where ferrite grains have a grain size of more than 20 $\mu$m, the prior austenite grains in the heat affected zone is rendered to have a grain size of 80 $\mu$m or more when a high heat input welding process is applied, thereby degrading the toughness of the heat affected zone.

Where the fraction of ferrite in the complex structure of ferrite and pearlite is increased, the toughness and elongation of the matrix are correspondingly increased. Accordingly, the fraction of ferrite is determined to be 20% or more, and preferably 70% or more.

It is desirable that complex precipitates of TiN and MnS having a grain size of 0.01 to 0.1 $\mu$m are dispersed in the welding structural steel product (matrix) of the present invention at a density of $1.0\times10^7/mm^2$.

Where the precipitates have a grain size of less than 0.01 $\mu$m, they may be easily dissolved again in the matrix in a welding process, so that they cannot effectively suppress the growth of austenite grains. On the other hand, where the precipitates have a grain size of more than 0.1 $\mu$m, they exhibit an insufficient pinning effect (suppression of growth of grains) on austenite grains, and behave like coarse non-metallic inclusions, thereby adversely affecting mechanical properties. Where the density of the fine precipitates is less than $1.0\times10^7/mm^2$, it is difficult to control the critical austenite grain size of the heat affected zone to be 80 $\mu$m or less where a welding process using high input heat is applied.

Where the precipitates are uniformly dispersed, it is possible to more effectively suppress the Ostwald ripening phenomenon causing coarsening of precipitates. Accordingly, it is desirable to control TiN precipitates to have a space of 0.5 $\mu$m.

Method for Manufacturing Weldable Structural Steel Products

In accordance with the present invention, a steel slab having the above defined composition is first prepared.

The steel slab of the present invention may be manufactured by conventionally processing, through a casting process, molten steel treated by conventional refining and deoxidizing processes. However, the present invention is not limited to such processes.

In accordance with the present invention, molten steel is primarily refined in a converter, and tapped into a ladle so that it may be subjected to a "refining outside furnace" process as a secondary refining process. In the case of thick products such as welding structural steel products, it is desirable to perform a degassing treatment (Ruhrstahi Hereaus (RH) process) after the "refining outside furnace" process. Typically, deoxidization is carried out between the primary and secondary refining processes.

In the deoxidizing process, it is most desirable to add Ti under the condition in which the amount of dissolved oxygen has been controlled not to be more than an appropriate level in accordance with the present invention. This is because most of Ti is dissolved in the molten steel without forming any oxide. In this case, an element having a deoxidizing effect higher than that of Ti is preferably added prior to the addition of Ti.

This will be described in more detail. The amount of dissolved oxygen greatly depends on an oxide production behavior. In the case of deoxidizing agents having a higher oxygen affinity, their rate of coupling with oxygen in molten steel is higher. Accordingly, where a deoxidation is carried out using an element having a deoxidizing effect higher than that of Ti, prior to the addition of Ti, it is possible to prevent Ti from forming an oxide, as much as possible. Of course, a deoxidation may be carried out under the condition that Mn, Si, etc. belonging to the 5 elements of steel are added prior to the addition of the element having a deoxidizing effect higher than that of Ti, for example, Al. After the deoxidation, a secondary deoxidation is carried out using Al. In this case, there is an advantage in that it is possible to reduce the amount of added deoxidizing agents. Respective deoxidizing effects of deoxidizing agents are as follows:

$$Cr<Mn<Si<Ti<Al<REM<Zr<Ca\approx Mg$$

As apparent from the above description, it is possible to control the amount of dissolved oxygen to be as low as possible by adding an element having a deoxidizing effect higher than that of Ti, prior to the addition of Ti, in accordance with the present invention. Preferably, the amount of dissolved oxygen is controlled to be 30 ppm or less. When the amount of dissolved oxygen exceeds 30 ppm, Ti may be coupled with oxygen existing in the molten steel, thereby forming a Ti oxide. As a result, the amount of dissolved Ti is reduced.

It is preferred that after the control of the dissolved oxygen amount, the addition of Ti be completed within 10 minutes under the condition that the content of Ti ranges from 0.005% to 0.2%. This is because the amount of dissolved Ti may be reduced with the lapse of time due to production of a Ti oxide after the addition of Ti.

In accordance with the present invention, the addition of Ti may be carried out at any time before or after a vacuum degassing treatment.

In accordance with the present invention, a steel slab is manufactured using the molten steel prepared as described above. Where the prepared molten steel is low-nitrogen steel (requiring a nitrogenizing treatment), it is possible to carry out a continuous casting process irrespective of its casting speed, that is, a low casting speed or a high casting speed. However, where the molten steel is high-nitrogen steel, it is desirable, in terms of an improvement in productivity, to cast the molten steel at a low casting speed while maintaining a weak cooling condition in the secondary cooling zone, taking into consideration the fact that high-nitrogen steel has a high possibility of formation of slab surface cracks.

Preferably, the casting speed of the continuous casting process is 1.1 m/min lower than a typical casting speed, that is, about 1.2 m/min. More preferably, the casting speed is controlled to be about 0.9 to 1.1 m/min. At a casting speed of less than 0.9 m/min, a degradation in productivity occurs even though there is an advantage in terms of reduction of slab surface cracks. On the other hand, where the casting speed is higher than 1.1 m/min, the possibility of formation of slab surface cracks is increased. Even in the case of low-nitrogen steel, it is possible to obtain a better internal quality when the steel is cast at a low speed of 0.9 to 1.2 m/min.

Meanwhile, it is desirable to control the cooling condition at the secondary cooling zone because the cooling condition influences the fineness and uniform dispersion of TiN precipitates.

For high-nitrogen molten steel, the water spray amount in the secondary cooling zone is determined to be 0.3 to 0.35 l/kg for weak cooling. When the water spray amount is less than 0.3 l/kg, coarsening of TiN precipitates occurs. As a result, it may be difficult to control the grain size and density of TiN precipitates in order to obtain desired effects according to the present invention. On the other hand, when the water spray amount is more than 0.35 l/kg, the frequency of formation of TiN precipitates is too low so that it is difficult to control the grain size and density of TiN precipitates in order to obtain desired effects according to the present invention.

Thereafter, the steel slab prepared as described above is heated in accordance with the present invention.

In the case of a high-nitrogen steel slab having a nitrogen content of 0.008 to 0.030%, it is heated at a temperature of 1,100 to 1,250° C. for 60 to 180 minutes. When the slab heating temperature is less than 1,100° C., it is difficult to secure the grain sizes and densities of precipitates of MnS and complex precipitates of TiN and MnS appropriate to obtain desired effects according to the present invention. On the other hand, when the slab heating temperature is more than 1,250° C., the grain size and density of complex precipitates of TiN and MnS are saturated. Also, austenite grains are grown during the heating process. As a result, the austenite grains, which influence recrystallization to be performed in a subsequent rolling process, are excessively coarsened, so that they exhibit a reduced effect of fining ferrite, thereby degrading the mechanical properties of the final steel product.

Meanwhile, where the slab heating time is less than 60 minutes, solidification segregation is reduced. Also, the given time is insufficient to allow complex precipitates of TiN and MnS to be dispersed. When the heating time exceeds 180 minutes, the effects obtained by the heating process are saturated. In this case, there is an increase in the manufacturing costs. Furthermore, growth of austenite grains occurs in the slab, adversely affecting the subsequent rolling process.

For a low-nitrogen steel slab containing nitrogen in an amount of 0.005%, a nitrogenizing treatment is carried out in a slab heating furnace in accordance with the present invention so as to obtain a high-nitrogen steel slab while adjusting the ratio between Ti and N.

In accordance with the present invention, the high-nitrogen slab is heated at a temperature of 1,000 to 1,250° C. for 60 to 180 minutes for a nitrogenizing treatment thereof, in order to control the nitrogen concentration of the slab to be preferably 0.008 to 0.03%. In order to secure an appropriate amount of TiN precipitates in the slab, the nitrogen content should be 0.008% or more. However, when the nitrogen content exceeds 0.03%, nitrogen may be diffused in the slab, thereby causing the amount of nitrogen at the surface of the slab to be more than the amount of nitrogen precipitated in the form of fine TiN precipitates. As a result, the slab is hardened at its surface, thereby adversely affecting the subsequent rolling process.

When the heating temperature of the slab is less than 1,000° C., nitrogen cannot be sufficiently diffused, thereby causing fine TiN precipitates to have a low density. Although it is possible to increase the density of TiN precipitates by increasing the heating time, this would increase the manufacturing costs. On the other hand, when the heating temperature is more than 1,250° C., growth of austenite grains occurs in the slab during the heating process, adversely affecting the recrystallization to be performed in the subsequent rolling process. Where the slab heating time is less than 60 minutes, it is impossible to obtain a desired nitrogenizing effect. On the other hand, where the slab heating time is more than 180 minutes, the manufacturing costs increase. Furthermore, growth of austenite grains occurs in the slab, adversely affecting the subsequent rolling process.

Preferably, the nitrogenizing treatment is performed to control, in the slab, the ratio of Ti/N to be 1.2 to 2.5, the ratio of N/B to be 10 to 40, the ratio of Al/N to be 2.5 to 7, the ratio of (Ti+2Al+4B)/N to be 6.5 to 14, the ratio of V/N to be 0.3 to 9, and the ratio of (Ti+2Al+4B+V)/N to be 7 to 17.

Thereafter, the heated steel slab is hot-rolled in an austenite recrystallization temperature range at a thickness reduction rate of 40% or more. The austenite recrystallization temperature range depends on the composition of the steel, and a previous thickness reduction rate. In accordance with the present invention, the austenite recrystallization temperature range is determined to be about 850 to 1,050° C., taking into consideration a typical thickness reduction rate, along with the steel composition of the present invention.

Where the hot rolling temperature is less than 850° C., the structure is changed into elongated austenite in the rolling process because the hot rolling temperature is within a non-crystallization temperature range. For this reason, it is difficult to secure fine ferrite in a subsequent cooling process. On the other hand, where the hot rolling temperature is more than 1,050° C., grains of recrystallized austenite formed in accordance with recrystallization are grown, so that they are coarsened. As a result, it is difficult to secure fine ferrite grains in the cooling process. Also, when the accumulated or single thickness reduction rate in the rolling process is less than 40%, there are insufficient sites for formation of ferrite nuclei within austenite grains. As a result, it is impossible to obtain an effect of sufficiently fine ferrite grains in accordance with recrystallization of austenite. Furthermore, there is an adverse effect on the behavior of precipitates advantageously influencing the toughness of the heat affected zone in a welding process.

The rolled steel slab is then cooled to a temperature ranging ±10° C. from a ferrite transformation finish temperature at a rate of 1° C./min. Preferably, the rolled steel slab is cooled to the ferrite transformation finish temperature at a rate of 1° C./min, and then cooled in air.

Of course, there is no problem associated with fining of ferrite even when the rolled steel slab is cooled to normal temperature at a rate of 1° C./min. However, this is undesirable because it is uneconomical. Although the rolled steel slab is cooled to a temperature ranging ±10° C. from the ferrite transformation finish temperature at a rate of 1° C./min, it is possible to prevent growth of ferrite grains. When the cooling rate is less than 1° C./min, growth of recrystallized fine ferrite grains occurs. In this case, it is difficult to secure a ferrite grain size of 20 μm or less.

It is possible to obtain a steel product having a complex structure of ferrite and pearlite as its microstructure while exhibiting a superior heat affected zone toughness by controlling deoxidizing and casting conditions while regulating content ratios of elements, in particular, the ratio of Ti/N. Also, it is possible to effectively manufacture a steel product in which complex precipitates of TiN and MnS having a grain size of 0.01 to 0.1 μm are precipitated at a density of $1.0\times10^7/mm^2$ or more while having a space of 0.5 μm or less.

Meanwhile, slabs can be manufactured using a continuous casting process or a mold casting process as a steel casting process. Where a high cooling rate is used, it is easy to finely disperse precipitates. Accordingly, it is desirable to use a continuous casting process. For the same reason, it is advantageous for the slab to have a small thickness. As the hot rolling process for such a slab, a hot charge rolling process or a direct rolling process may be used. Also, various techniques such as known controlled rolling processes and controlled cooling processes may be employed. In order to improve the mechanical properties of hot-rolled plates manufactured in accordance with the present invention, a heat treatment may be applied. It should be noted that although such known techniques are applied to the present invention, such an application is made within the scope of the present invention.

Welded Structures

The present invention also relates to a welded structure manufactured using the above described welded structural steel product. Therefore, included in the present invention are welded structures manufactured using a welded structural steel product having the above defined composition according to the present invention, a microstructure corresponding to a complex structure of ferrite and pearlite having a grain size of about 20 μm or less, or complex precipitates of TiN and MnS having a grain size of 0.01 to 0.1 μm while being dispersed at a density of $1.0\times10^7/mm^2$ or more and with a spacing of 0.5 μm or less.

Where a high heat input welding process is applied to the above described welded structural steel product, prior austenite having a grain size of 80 μm or less is formed. Where the grain size of the prior austenite is more than 80 μm, an increase in hardenability occurs, thereby causing easy formation of a low-temperature structure (martensite or upper bainite). Furthermore, although ferrites having different nucleus forming sites are formed at grain boundaries of austenite, they are merged together when growth of grains occurs, thereby causing an adverse effect on toughness.

When the steel product is quenched in accordance with an application of a high heat input welding process thereto, the microstructure of the heat affected zone includes ferrite having a grain size of 20 μm or less at a volume fraction of 70% or more. Where the grain size of the ferrite is more than 20 μm, the fraction of side plate or allotriomorphs ferrite adversely affecting the toughness of the heat affected zone increases. In order to achieve an improvement in toughness, it is desirable to control the volume fraction of ferrite to be 70% or more. When the ferrite of the present invention has characteristics of polygonal ferrite or acicular ferrite, an improvement in toughness is expected. In accordance with the present invention, this can be achieved by forming BN and Fe-based carbide boride.

When a high heat input welding process is applied to the welded structural steel product (matrix), prior austenite having a grain size of 80 μm or less is formed at the heat affected zone. In accordance with a subsequent quenching process, the microstructure of the heat affected zone includes ferrite having a grain size of 20 μm or less at a volume fraction of 70% or more.

Where a welding process using a heat input of 100 kJ/cm or less is applied to the welding structural steel product of the present invention (in the case "$\Delta t_{800-500}$=60 seconds" in Table 5), the toughness difference between the matrix and the heat affected zone is within a range of ±30 J. In the case of a welding process using a high heat input of 100 to 250 kJ/cm or more ("$\Delta_{800-500}$=120 seconds" in Table 5), the toughness difference between the matrix and the heat affected zone is within a range of ±40 J. Also, in the case of a welding process using a high heat input of 250 kJ/cm or more ("$\Delta t_{800-500}$=180 seconds" in Table 5), the toughness difference between the matrix and the heat affected zone is within a range of 0 to 100 J. Such results can be seen from the following examples.

EXAMPLES

Hereinafter, the present invention will be described in conjunction with various examples. These examples are made only for illustrative purposes, and the present invention is not to be construed as being limited to those examples.

Example 1

Each of the steel products having different steel compositions set forth in Table 1 was melted in a converter. The resultant molten steel was subjected to a continuous casting process after being refined under the conditions reported in Table 2, thereby manufacturing a slab. The slab was then hot rolled under the conditions of Table 4, thereby manufacturing a hot-rolled plate. Table 3 describes the content ratios of various alloying elements in each steel product.

TABLE 1

| | Chemical Composition (wt %) | | | | | | | | | |
|---|---|---|---|---|---|---|---|---|---|---|
| | C | Si | Mn | P | S | Al | Ti | B (ppm) | N (ppm) | W |
| Present Steel 1 | 0.12 | 0.13 | 1.54 | 0.006 | 0.005 | 0.04 | 0.014 | 7 | 120 | 0.005 |
| Present Steel 2 | 0.07 | 0.12 | 1.71 | 0.006 | 0.006 | 0.07 | 0.05 | 10 | 280 | 0.002 |
| Present Steel 3 | 0.14 | 0.10 | 2.01 | 0.006 | 0.008 | 0.06 | 0.015 | 3 | 110 | 0.003 |
| Present Steel 4 | 0.10 | 0.12 | 1.80 | 0.006 | 0.007 | 0.02 | 0.02 | 5 | 80 | 0.001 |
| Present Steel 5 | 0.08 | 0.15 | 2.1 | 0.006 | 0.006 | 0.09 | 0.05 | 15 | 300 | 0.002 |
| Present Steel 6 | 0.10 | 0.14 | 2.0 | 0.007 | 0.005 | 0.025 | 0.02 | 10 | 100 | 0.004 |
| Present Steel 7 | 0.13 | 0.14 | 1.6 | 0.007 | 0.007 | 0.04 | 0.015 | 8 | 115 | 0.15 |
| Present Steel 8 | 0.11 | 0.15 | 1.52 | 0.007 | 0.006 | 0.06 | 0.018 | 10 | 120 | 0.001 |
| Present Steel 9 | 0.13 | 0.21 | 1.42 | 0.007 | 0.005 | 0.025 | 0.02 | 4 | 90 | 0.002 |
| Present Steel 10 | 0.07 | 0.16 | 2.2 | 0.008 | 0.010 | 0.045 | 0.025 | 6 | 100 | 0.05 |
| Present Steel 11 | 0.11 | 0.21 | 1.48 | 0.007 | 0.006 | 0.047 | 0.019 | 11 | 130 | 0.01 |
| Conventional Steel 1 | 0.05 | 0.13 | 1.31 | 0.002 | 0.006 | 0.0014 | 0.009 | 1.6 | 22 | — |
| Conventional Steel 2 | 0.05 | 0.11 | 1.34 | 0.002 | 0.003 | 0.0036 | 0.012 | 0.5 | 48 | — |
| Conventional Steel 3 | 0.13 | 0.24 | 1.44 | 0.0012 | 0.003 | 0.0044 | 0.010 | 1.2 | 127 | — |
| Conventional Steel 4 | 0.06 | 0.18 | 1.35 | 0.008 | 0.002 | 0.0027 | 0.013 | 8 | 32 | — |
| Conventional Steel 5 | 0.06 | 0.18 | 0.88 | 0.006 | 0.002 | 0.0021 | 0.013 | 5 | 20 | — |
| Conventional Steel 6 | 0.13 | 0.27 | 0.98 | 0.005 | 0.001 | 0.001 | 0.009 | 11 | 28 | — |
| Conventional Steel 7 | 0.13 | 0.24 | 1.44 | 0.004 | 0.002 | 0.02 | 0.008 | 8 | 79 | — |
| Conventional Steel 8 | 0.07 | 0.14 | 1.52 | 0.004 | 0.002 | 0.002 | 0.007 | 4 | 57 | — |
| Conventional Steel 9 | 0.06 | 0.25 | 1.31 | 0.008 | 0.002 | 0.019 | 0.007 | 10 | 91 | — |
| Conventional Steel 10 | 0.09 | 0.26 | 0.86 | 0.009 | 0.003 | 0.046 | 0.008 | 15 | 142 | — |
| Conventional Steel 11 | 0.14 | 0.44 | 1.35 | 0.012 | 0.012 | 0.030 | 0.049 | 7 | 89 | — |

| | Chemical Composition (wt %) | | | | | | | | |
|---|---|---|---|---|---|---|---|---|---|
| | Cu | Ni | Cr | Mo | Nb | V | Ca | REM | O (ppm) |
| Present Steel 1 | 0.1 | — | — | — | — | 0.01 | — | — | 11 |
| Present Steel 2 | — | 0.2 | — | — | — | 0.01 | — | — | 12 |
| Present Steel 3 | — | — | — | — | — | 0.02 | — | — | 10 |
| Present Steel 4 | 0.1 | — | — | — | — | 0.05 | — | — | 9 |
| Present Steel 5 | — | — | 0.1 | — | — | 0.05 | — | — | 12 |
| Present Steel 6 | — | — | — | 0.1 | — | 0.09 | — | — | 9 |
| Present Steel 7 | 0.1 | — | — | — | — | 0.02 | — | — | 11 |
| Present Steel 8 | — | — | — | — | 0.015 | 0.01 | — | — | 10 |
| Present Steel 9 | — | — | 0.1 | — | — | 0.02 | 0.001 | — | 12 |
| Present Steel 10 | — | 0.3 | — | — | 0.01 | 0.02 | — | 0.01 | 11 |
| Present Steel 11 | — | 0.1 | — | — | — | — | — | — | 15 |
| Conventional Steel 1 | — | — | — | — | — | — | — | — | 22 |

TABLE 1-continued

| | | | | | | | | | |
|---|---|---|---|---|---|---|---|---|---|
| Conventional Steel 2 | — | — | — | — | — | — | — | — | 32 |
| Conventional Steel 3 | 0.3 | — | — | — | 0.05 | — | — | — | 138 |
| Conventional Steel 4 | — | — | 0.14 | 0.15 | — | 0.028 | — | — | 25 |
| Conventional Steel 5 | 0.75 | 0.58 | 0.24 | 0.14 | 0.015 | 0.037 | — | — | 27 |
| Conventional Steel 6 | 0.35 | 1.15 | 0.53 | 0.49 | 0.001 | 0.045 | — | — | 25 |
| Conventional Steel 7 | 0.3 | — | — | — | 0.036 | — | — | | — |
| Conventional Steel 8 | 0.32 | 0.35 | — | — | 0.013 | — | — | — | — |
| Conventional Steel 9 | — | — | 0.21 | 0.19 | 0.025 | 0.035 | — | — | — |
| Conventional Steel 10 | — | 1.09 | 0.51 | 0.36 | 0.021 | 0.021 | — | — | — |
| Conventional Steel 11 | — | — | — | — | — | 0.069 | — | — | — |

The conventional steels 1, 2 and 3 are the inventive steels 5, 32, and 55 of Japanese Patent Laid-open Publication No. Hei. 9-194990.
The conventional steels 4, 5, and 6 are the inventive steels 14, 24, and 28 of Japanese Patent Laid-open Publication No. Hei. 10-298708.
The conventional steels 7, 8, 9, and 10 are the inventive steels 48, 58, 60, 61 of Japanese Patent Laid-open Publication No. Hei. 8-60292.
The conventional steel 11 is the inventive steel F of Japanese Paten Laid-open Publication No. Hei. 11-140582.

TABLE 2

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| PS* 1 | PS 1 | Mn → Si | 19 | 0.014 | 1.1 | 0.32 |
| | PS 2 | Mn → Si | 18 | 0.014 | 1.1 | 0.32 |
| | PS 3 | Mn → Si | 18 | 0.014 | 1.1 | 0.32 |
| | CS 1 | Mn → Si | 32 | 0.014 | 1.1 | 0.32 |
| | CS 2 | Mn → Si | 58 | 0.014 | 1.1 | 0.32 |
| PS* 2 | PS 4 | Mn → Si | 16 | 0.05 | 1.0 | 0.35 |
| PS* 3 | PS 5 | Mn → Si | 15 | 0.015 | 1.0 | 0.35 |
| PS* 4 | PS 6 | Mn → Si | 15 | 0.02 | 1.0 | 0.35 |
| PS* 5 | PS 7 | Mn → Si | 12 | 0.05 | 1.2 | 0.30 |
| PS* 6 | PS 8 | Mn → Si | 17 | 0.02 | 1.2 | 0.30 |
| PS* 7 | PS 9 | Mn → Si | 18 | 0.015 | 1.1 | 0.32 |
| PS* 8 | PS 10 | Mn → Si | 14 | 0.018 | 1.1 | 0.32 |
| PS* 9 | PS 11 | Mn → Si | 19 | 0.02 | 1.1 | 0.32 |
| PS* 10 | PS 12 | Mn → Si | 22 | 0.025 | 1.0 | 0.35 |
| PS* 11 | PS 13 | Mn → Si | 20 | 0.019 | 1.0 | 0.35 |

There is no detailed manufacturing condition for the conventional steels 1 to 11
PS: Present Sample
PS*: Present Steel
CS: Comparative Sample
CS*: Conventional Steel

TABLE 3

| | Content Ratios of Alloying Elements | | | | | |
|---|---|---|---|---|---|---|
| Steel Product | Mn/S | Ti/N | N/B | Al/N | V/N | (Ti + 2Al + 4B + V)/N |
| Present Sample 1 | 308 | 1.2 | 17.1 | 3.3 | 0.8 | 8.9 |
| Present Sample 2 | 308 | 1.2 | 17.1 | 3.3 | 0.8 | 8.9 |
| Present Sample 3 | 308 | 1.2 | 17.1 | 3.3 | 0.8 | 8.9 |
| Present Sample 4 | 285 | 1.8 | 28.0 | 2.5 | 0.4 | 7.3 |
| Present Sample 5 | 251 | 1.4 | 36.7 | 5.5 | 1.8 | 14.2 |
| Present Sample 6 | 257 | 2.5 | 16.0 | 2.5 | 6.3 | 14.0 |

TABLE 3-continued

| Steel Product | Content Ratios of Alloying Elements | | | | | |
|---|---|---|---|---|---|---|
| | Mn/S | Ti/N | N/B | Al/N | V/N | (Ti + 2Al + 4B + V)/N |
| Present Sample 7 | 350 | 1.7 | 20.0 | 3.0 | 1.7 | 9.5 |
| Present Sample 8 | 400 | 2.0 | 10.0 | 2.5 | 9.0 | 16.4 |
| Present Sample 9 | 229 | 1.3 | 14.4 | 3.5 | 1.7 | 10.3 |
| Present Sample 10 | 253 | 1.5 | 12.0 | 5.0 | 0.8 | 12.7 |
| Present Sample 11 | 284 | 2.2 | 22.5 | 2.8 | 2.2 | 10.2 |
| Present Sample 12 | 220 | 2.5 | 16.7 | 4.5 | 2.0 | 13.7 |
| Present Sample 13 | 247 | 1.5 | 11.8 | 3.6 | — | 9.0 |
| Conventional Steel 1 | 218 | 4.1 | 13.8 | 0.6 | — | 5.7 |
| Conventional Steel 2 | 447 | 2.5 | 96.0 | 0.8 | — | 4.0 |
| Conventional Steel 3 | 480 | 0.8 | 105.8 | 0.4 | — | 1.5 |
| Conventional Steel 4 | 657 | 4.1 | 4.0 | 0.8 | 8.8 | 15.5 |
| Conventional Steel 5 | 440 | 6.5 | 4.0 | 1.1 | 18.5 | 28.1 |
| Conventional Steel 6 | 980 | 3.2 | 2.6 | 0.4 | 16.1 | 21.6 |
| Conventional Steel 7 | 720 | 1.0 | 9.9 | 2.5 | — | 6.5 |
| Conventional Steel 8 | 760 | 1.2 | 14.3 | 0.4 | — | 2.2 |
| Conventional Steel 9 | 655 | 0.8 | 9.1 | 2.1 | 3.9 | 9.2 |
| Conventional Steel 10 | 287 | 0.6 | 9.5 | 3.2 | 1.5 | 8.9 |
| Conventional Steel 11 | 113 | 5.5 | 12.7 | 3.4 | 7.8 | 20.3 |

TABLE 4

| Steel Products | Samples | Heating Temp. (° C.) | Heating Time (min) | Rolling Start Temp. (° C.) | Rolling End Time (° C.) | TRR (%)/ ATRR (%) | Cooling Rate (° C./min) |
|---|---|---|---|---|---|---|---|
| Present Sample 2 | Present Example 1 | 1150 | 170 | 1030 | 850 | 65/80 | 5 |
| | Present Example 2 | 1200 | 130 | 1040 | 850 | 65/80 | 5 |
| | Present Example 3 | 1240 | 90 | 1040 | 850 | 65/80 | 5 |
| | Comparative Example 1 | 1050 | 60 | 1040 | 850 | 65/80 | 5 |
| | Comparative Example 2 | 1300 | 250 | 1035 | 850 | 65/80 | 5 |
| Present Sample 1 | Present Example 4 | 1200 | 130 | 1020 | 840 | 65/80 | 6 |
| Present Sample 3 | Present Example 5 | 1200 | 130 | 1040 | 850 | 65/80 | 6 |
| Comparative Sample 1 | Comparative Example 3 | 1210 | 120 | 1030 | 860 | 65/80 | 0.01 |
| Comparative Sample 2 | Comparative Example 4 | 1210 | 120 | 1030 | 860 | 65/80 | 35 |
| Present Sample 4 | Present Example 6 | 1180 | 150 | 1020 | 860 | 60/80 | 5 |
| Present Sample 5 | Present Example 7 | 1190 | 140 | 1010 | 850 | 60/80 | 5 |
| Present Sample 6 | Present Example 8 | 1220 | 110 | 1010 | 840 | 60/75 | 6 |
| Present Sample 7 | Present Example 9 | 1220 | 110 | 1020 | 840 | 60/75 | 7 |
| Present Sample 8 | Present Example 10 | 1210 | 120 | 1010 | 850 | 60/75 | 7 |

TABLE 4-continued

| Steel Products | Samples | Heating Temp. (° C.) | Heating Time (min) | Rolling Start Temp. (° C.) | Rolling End Time (° C.) | TRR (%)/ ATRR (%) | Cooling Rate (° C./min) |
|---|---|---|---|---|---|---|---|
| Present Sample 9 | Present Example 11 | 1220 | 110 | 1000 | 840 | 55/70 | 5 |
| Present Sample 10 | Present Example 12 | 1210 | 120 | 1010 | 830 | 55/70 | 6 |
| Present Sample 11 | Present Example 13 | 1230 | 100 | 1000 | 850 | 55/70 | 5 |
| Present Sample 12 | Present Example 14 | 1220 | 110 | 1020 | 840 | 55/70 | 5 |
| Present Sample 13 | Present Example 15 | 1210 | 130 | 1020 | 840 | 65/75 | 5 |
| Conventional Steel 11 | | 1200 | — | $Ar_3$ or more | 960 | 80 | Naturally Cooled |

The cooling of each present sample is carried out under the condition in which its cooling rate is controlled, until the temperature of the sample reaches 500° C. corresponding to a ferrite transformation completion temperature. Following this temperature, the present sample is cooled in air.
There is no detailed manufacturing condition for the conventional steels 1 to 10.
TRR/ATRR: Thickness Reduction Rate/Accumulated Thickness Reduction Rate in Recrystallization Range Test pieces were sampled from the hot-rolled products. The sampling was performed at the central portion of each hot-rolled product in a thickness direction. In particular, test pieces for a tensile test were sampled in a rolling direction, whereas test pieces for a Charpy impact test were sampled in a direction perpendicular to the rolling direction. Using steel test pieces sampled as described above, characteristics of precipitates in each steel product (matrix), and mechanical properties of the steel product were measured. The measured results are described in Table 5. Also, the microstructure and impact toughness of the heat affected zone were measured. The measured results are described in Table 6.

These measurements were carried out as follows.

For tensile test pieces, test pieces of KS Standard No. 4 (KS B 0801) were used. The tensile test was carried out at a cross heat speed of 5 mm/min. On the other hand, impact test pieces were prepared, based on the test piece of KS Standard No. 3 (KS B 0809). For the impact test pieces, notches were machined at a side surface (L-T) in a rolling direction in the case of the matrix while being machined in a welding line direction in the case of the welding material. In order to inspect the size of austenite grains at a maximum heating temperature of the heat affected zone, each test piece was heated to a maximum heating temperature of 1,200 to 1,400° C. at a heating rate of 140° C./sec using a reproducible welding simulator, and then quenched using He gas after being maintained for one second. After the quenched test piece was polished and eroded, the grain size of austenite in the resultant test piece at a maximum heating temperature condition was measured in accordance with a KS Standard (KS D 0205).

The microstructure obtained after the cooling process, and the grain sizes, densities, and spacing of precipitates and oxides seriously influencing the toughness of the heat affected zone were measured in accordance with a point counting scheme using an image analyzer and an electronic microscope. The measurement was carried out for a test area of 100 $mm^2$. The impact toughness of the heat affected zone in each test piece was evaluated by subjecting the test piece to welding conditions corresponding to welding heat inputs of about 80 kJ/cm, 150 kJ/cm, and 250 kJ/cm, that is, welding cycles involving heating at a maximum heating temperature of 1,400° C., and cooling for 60 seconds, 120 seconds, and 180 seconds, respectively, polishing the surface of the test piece, machining the test piece for an impact test, and then conducting a Charpy impact test for the test piece at a temperature of −40° C.

TABLE 5

| | Characteristics of Precipitates of TiN + MnS | | | Characteristics of Matrix Structure and Mechanical Properties of Matrix | | | | | | |
|---|---|---|---|---|---|---|---|---|---|---|
| Sample | Density (number/ $mm^2$) | Mean Size (μm) | Spacing (μm) | Thickness (mm) | Yield Strength (MPa) | Tensile Strength (MPa) | Elongation (%) | FGS (μm) | Volume Fraction of Ferrite (%) | −40° C. Impact Toughness (J) |
| PE 1 | $2.4 \times 10^8$ | 0.016 | 0.25 | 25 | 394 | 553 | 38 | 11 | 82 | 358 |
| PE 2 | $3.2 \times 10^8$ | 0.017 | 0.24 | 25 | 395 | 551 | 39 | 9 | 83 | 362 |
| PE 3 | $2.5 \times 10^8$ | 0.012 | 0.26 | 25 | 396 | 550 | 39 | 10 | 83 | 357 |
| CE 1 | $2.3 \times 10^6$ | 0.174 | 1.6 | 25 | 393 | 554 | 26 | 16 | 70 | 206 |
| CE 2 | $3.4 \times 10^6$ | 0.165 | 1.8 | 25 | 792 | 860 | 17 | 17 | 21 | 45 |
| PE 4 | $3.2 \times 10^8$ | 0.025 | 0.32 | 30 | 396 | 558 | 38 | 11 | 83 | 349 |
| PE 5 | $2.6 \times 10^8$ | 0.013 | 0.34 | 30 | 396 | 562 | 38 | 10 | 83 | 354 |
| CE 3 | $1.3 \times 10^6$ | 0.182 | 1.2 | 30 | 384 | 564 | 30 | 18 | 73 | 220 |
| CE 4 | $4.3 \times 10^6$ | 0.177 | 1.4 | 30 | 392 | 582 | 29 | 17 | 74 | 208 |
| PE 6 | $3.3 \times 10^8$ | 0.026 | 0.35 | 30 | 390 | 563 | 38 | 10 | 82 | 364 |
| PE 7 | $4.6 \times 10^8$ | 0.024 | 0.32 | 35 | 390 | 564 | 39 | 10 | 85 | 360 |

TABLE 5-continued

| Sample | Characteristics of Precipitates of TiN + MnS: Density (number/mm$^2$) | Mean Size (μm) | Spacing (μm) | Characteristics of Matrix Structure and Mechanical Properties of Matrix: Thickness (mm) | Yield Strength (MPa) | Tensile Strength (MPa) | Elongation (%) | FGS (μm) | Volume Fraction of Ferrite (%) | −40° C. Impact Toughness (J) |
|---|---|---|---|---|---|---|---|---|---|---|
| PE 8 | $4.3 \times 10^8$ | 0.014 | 0.40 | 35 | 392 | 542 | 36 | 11 | 82 | 365 |
| PE 9 | $5.6 \times 10^8$ | 0.028 | 0.29 | 35 | 391 | 536 | 37 | 10 | 84 | 359 |
| PE 10 | $5.2 \times 10^8$ | 0.021 | 0.28 | 35 | 394 | 566 | 36 | 10 | 83 | 375 |
| PE 11 | $3.7 \times 10^8$ | 0.029 | 0.25 | 40 | 390 | 566 | 37 | 12 | 83 | 364 |
| PE 12 | $3.2 \times 10^8$ | 0.025 | 0.31 | 40 | 396 | 542 | 38 | 11 | 85 | 356 |
| PE 13 | $3.3 \times 10^8$ | 0.042 | 0.34 | 40 | 406 | 564 | 38 | 12 | 82 | 348 |
| PE 14 | $3.6 \times 10^8$ | 0032 | 0.28 | 40 | 387 | 550 | 37 | 10 | 83 | 349 |
| PE 15 | $4.2 \times 10^8$ | 0.018 | 0.26 | 30 | 389 | 549 | 39 | 9 | 86 | 368 |
| CS 1 | | | | 35 | 406 | 436 | | | | |
| CS 2 | | | | 35 | 405 | 441 | | | | |
| CS 3 | | | | 25 | 629 | 681 | | | | |
| CS 4 | Precipitates of MgO—TiN $3.03 \times 10^6$/mm$^2$ | | | 40 | 472 | 609 | | | | |
| CS 5 | Precipitates of MgO—TiN $4.07 \times 10^6$/mm$^2$ | | | 40 | 494 | 622 | | | | |
| CS 6 | Precipitates of MgO—TiN $2.80 \times 10^6$/mm$^2$ | | | 50 | 812 | 912 | | | | |
| CS 7 | | | | 25 | 629 | 681 | | | | |
| CS 8 | | | | 50 | 504 | 601 | | | | |
| CS 9 | | | | 60 | 526 | 648 | | | | |
| CS 10 | | | | 60 | 760 | 829 | | | | |
| CS 11 | | | | 50 | 401 | 514 | | | | |

PE: Present Example
CE: Comparative Example
CS: Conventional Steel

Referring to Table 5, it can be seen that the density of precipitates (complex precipitates of TiN and MnS) in each hot-rolled product manufactured in accordance with the present invention is $1.0 \times 10^8$/mm$^2$ or more, whereas the density of precipitates in each conventional product is $4.07 \times 10^5$/mm$^2$ or less. That is, the product of the present invention is formed with precipitates having a very small grain size while being dispersed at a considerably increased density.

The products of the present invention have a matrix structure having fine ferrite with a grain size of about 8 μm or less at a high fraction of 87% or more.

TABLE 6

| Sample | Grain Size of Austenite in Heat Affected Zone (μm): 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Mechanical Properties of Welded Zone, $\Delta t_{800\text{-}500}$ = 180 sec: Yield Strength (kg/mm$^2$) | Tensile Strength (kg/mm$^2$) | Reproducible Heat Affected Zone Impact Toughness (J) at −40° C. (Maximum Heating Temp. 1,400° C.), $\Delta t_{800\text{-}500}$ = 120 sec: Impact Toughness (J) | Transition Temp. (° C.) | $\Delta t_{800\text{-}500}$ = 180 sec: Impact Toughness (J) | Transition Temp. (° C.) |
|---|---|---|---|---|---|---|---|---|---|---|---|
| PE 1 | 23 | 33 | 56 | 73 | 16 | 370 | −74 | 330 | −67 | 294 | −62 |
| PE 2 | 22 | 34 | 55 | 76 | 15 | 383 | −76 | 353 | −69 | 301 | −63 |
| PE 3 | 23 | 32 | 56 | 74 | 17 | 365 | −72 | 331 | −67 | 298 | −63 |
| CE 1 | 54 | 84 | 182 | 36 | 32 | 126 | −43 | 47 | −34 | 26 | −27 |
| CE 2 | 65 | 91 | 198 | 37 | 35 | 104 | −40 | 35 | −32 | 18 | −26 |
| PE 4 | 25 | 37 | 65 | 75 | 18 | 353 | −71 | 325 | −68 | 287 | −64 |
| PE 5 | 26 | 40 | 57 | 74 | 16 | 362 | −71 | 333 | −67 | 296 | −61 |
| CE 3 | 48 | 78 | 220 | 58 | 22 | 182 | −44 | 87 | −36 | 36 | −28 |
| CE 4 | 56 | 82 | 254 | 52 | 26 | 176 | −44 | 79 | −35 | 32 | −29 |
| PE 6 | 25 | 31 | 53 | 76 | 17 | 386 | −73 | 353 | −69 | 305 | −62 |
| PE 7 | 24 | 34 | 55 | 74 | 18 | 367 | −71 | 338 | −67 | 293 | −63 |
| PE 8 | 27 | 36 | 53 | 73 | 14 | 364 | −71 | 334 | −67 | 294 | −61 |
| PE 9 | 24 | 36 | 52 | 74 | 17 | 367 | −72 | 335 | −67 | 285 | −62 |
| PE 10 | 22 | 35 | 53 | 73 | 18 | 385 | −72 | 345 | −66 | 294 | −61 |
| PE 11 | 26 | 34 | 64 | 74 | 16 | 358 | −71 | 324 | −68 | 285 | −63 |
| PE 12 | 27 | 38 | 64 | 74 | 18 | 355 | −71 | 324 | −67 | 284 | −62 |
| PE 13 | 24 | 32 | 54 | 75 | 16 | 367 | −72 | 336 | −68 | 285 | −63 |

TABLE 6-continued

| Sample | Grain Size of Austenite in Heat Affected Zone (μm) 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Mechanical Properties of Welded Zone: Δ $t_{800-500}$ = 180 sec Yield Strength (kg/mm²) | Tensile Strength (kg/mm²) | Reproducible Heat Affected Zone Impact Toughness (J) at −40° C. (Maximum Heating Temp. 1,400° C.): Δ $t_{800-500}$ = 120 sec Impact Toughness (J) | Transition Temp. (° C.) | Δ $t_{800-500}$ = 180 sec Impact Toughness (J) | Transition Temp. (° C.) |
|---|---|---|---|---|---|---|---|---|---|---|---|
| PE 14 | 25 | 31 | 58 | 72 | 17 | 365 | −72 | 330 | −68 | 280 | −63 |
| PE 15 | 24 | 32 | 54 | 76 | 14 | 368 | −72 | 345 | −68 | 286 | −63 |
| CS 1 | | | | | | 187 | −51 | | | | |
| CS 2 | | | | | | 156 | −48 | | | | |
| CS 3 | | | | | | 148 | −50 | | | | |
| CS 4 | | 230 | | 93 | | 143 | −48 | | | 132(0° C.) | |
| CS 5 | | 180 | | 87 | | 132 | −45 | | | 129(0° C.) | |
| CS 6 | | 250 | | 47 | | 153 | −43 | | | 60(0° C.) | |
| CS 7 | | | | | | 141 | −54 | | | | −61 |
| CS 8 | | | | | | 156 | −59 | | | | −48 |
| CS 9 | | | | | | 145 | −54 | | | | −42 |
| CS 10 | | | | | | 138 | −57 | | | | −45 |
| CS 11 | | | | | | 141 | −43 | 219(0° C.) | | | |

PE: Present Example
CE: Comparative Example
CS: Conventional Steel

Referring to Table 6, it can be seen that the size of austenite grains under a maximum heating temperature condition of 1,400° C., as in the heat affected zone, is within a range of 52 to 65 μm in the case of the present invention, whereas the austenite grains in the conventional products are very coarse to have a grain size of about 180 μm. Thus, the steel products of the present invention have a superior effect of suppressing the growth of austenite grains at the heat affected zone in a welding process. Where a welding process using a heat input of 100 kJ/cm is applied, the steel products of the present invention have a ferrite fraction of about 70% or more.

Under a high heat input welding condition in which a welding heat input is 250 kJ/cm (the time taken for cooling from 800° C. to 500° C. is 180 seconds), the products of the present invention exhibit a superior toughness value of about 280 J or more as a heat affected zone impact toughness at −40° C. while exhibiting about −60° C. as a transition temperature. That is, the products of the present invention exhibit a superior heat affected zone impact toughness under a high heat input welding condition.

Under the same high heat input welding condition, the conventional steel products exhibit a toughness value of about 200 J as a heat affected zone impact toughness at 0° C. while exhibiting about −60° C. as a transition temperature.

Example 2

Nitrogenizing Treatment

Each of steel products having different steel compositions of Table 7 was melted in a converter. The resultant molten steel was subjected to a continuous casting process after being deoxidized while being subsequently added with Ti, thereby manufacturing a slab.

The slab was then hot rolled under the condition of Table 9, thereby manufacturing a hot-rolled plate. Table 10 describes content ratios of alloying elements in each steel product.

TABLE 7

| | Chemical Composition (wt %) | | | | | | | | | |
|---|---|---|---|---|---|---|---|---|---|---|
| | C | Si | Mn | P | S | Al | Ti | B (ppm) | N (ppm) | W |
| Present Steel 1 | 0.12 | 0.13 | 1.54 | 0.006 | 0.005 | 0.04 | 0.014 | 7 | 40 | 0.005 |
| Present Steel 2 | 0.07 | 0.12 | 1.50 | 0.006 | 0.005 | 0.07 | 0.05 | 10 | 43 | 0.002 |
| Present Steel 3 | 0.14 | 0.10 | 1.55 | 0.006 | 0.007 | 0.06 | 0.015 | 3 | 41 | 0.003 |
| Present Steel 4 | 0.10 | 0.12 | 1.48 | 0.006 | 0.005 | 0.02 | 0.02 | 5 | 40 | 0.001 |
| Present Steel 5 | 0.08 | 0.15 | 1.52 | 0.006 | 0.004 | 0.09 | 0.05 | 15 | 43 | 0.002 |
| Present Steel 6 | 0.10 | 0.14 | 1.50 | 0.007 | 0.005 | 0.025 | 0.02 | 10 | 40 | 0.004 |
| Present Steel 7 | 0.13 | 0.14 | 1.59 | 0.007 | 0.007 | 0.04 | 0.015 | 8 | 45 | 0.15 |

TABLE 7-continued

| | | | | | | | | | | |
|---|---|---|---|---|---|---|---|---|---|---|
| Present Steel 8 | 0.11 | 0.15 | 1.54 | 0.007 | 0.007 | 0.06 | 0.018 | 10 | 42 | 0.001 |
| Present Steel 9 | 0.13 | 0.21 | 1.50 | 0.007 | 0.005 | 0.025 | 0.02 | 4 | 40 | 0.002 |
| Present Steel 10 | 0.07 | 0.16 | 1.45 | 0.008 | 0.006 | 0.045 | 0.025 | 6 | 41 | 0.05 |
| Present Steel 11 | 0.09 | 0.21 | 1.47 | 0.006 | 0.004 | 0.047 | 0.019 | 11 | 42 | 0.01 |
| Conventional Steel 1 | 0.05 | 0.13 | 1.31 | 0.002 | 0.006 | 0.0014 | 0.009 | 1.6 | 22 | — |
| Conventional Steel 2 | 0.05 | 0.11 | 1.34 | 0.002 | 0.003 | 0.0036 | 0.012 | 0.5 | 48 | — |
| Conventional Steel 3 | 0.13 | 0.24 | 1.44 | 0.0012 | 0.003 | 0.0044 | 0.010 | 1.2 | 127 | — |
| Conventional Steel 4 | 0.06 | 0.18 | 1.35 | 0.008 | 0.002 | 0.0027 | 0.013 | 8 | 32 | — |
| Conventional Steel 5 | 0.06 | 0.18 | 0.88 | 0.006 | 0.002 | 0.0021 | 0.013 | 5 | 20 | — |
| Conventional Steel 6 | 0.13 | 0.27 | 0.98 | 0.005 | 0.001 | 0.001 | 0.009 | 11 | 28 | — |
| Conventional Steel 7 | 0.13 | 0.24 | 1.44 | 0.004 | 0.002 | 0.02 | 0.008 | 8 | 79 | — |
| Conventional Steel 8 | 0.07 | 0.14 | 1.52 | 0.004 | 0.002 | 0.002 | 0.007 | 4 | 57 | — |
| Conventional Steel 9 | 0.06 | 0.25 | 1.31 | 0.008 | 0.002 | 0.019 | 0.007 | 10 | 91 | — |
| Conventional Steel 10 | 0.09 | 0.26 | 0.86 | 0.009 | 0.003 | 0.046 | 0.008 | 15 | 142 | — |
| Conventional Steel 11 | 0.14 | 0.44 | 1.35 | 0.012 | 0.012 | 0.030 | 0.049 | 7 | 89 | — |

| | Chemical Composition (wt %) | | | | | | | | |
|---|---|---|---|---|---|---|---|---|---|
| | Cu | Ni | Cr | Mo | Nb | V | Ca | REM | O (ppm) |
| Present Steel 1 | 0.2 | — | — | — | — | 0.01 | — | — | 11 |
| Present Steel 2 | 0.1 | 0.2 | — | — | — | 0.01 | — | — | 12 |
| Present Steel 3 | 0.1 | — | — | — | — | 0.02 | — | — | 10 |
| Present Steel 4 | 0.3 | — | — | — | — | 0.05 | — | — | 9 |
| Present Steel 5 | 0.1 | — | 0.1 | — | — | 0.05 | — | — | 12 |
| Present Steel 6 | 0.45 | — | — | 0.1 | — | 0.09 | — | — | 9 |
| Present Steel 7 | 0.1 | — | — | — | — | 0.02 | — | — | 11 |
| Present Steel 8 | 0.3 | — | — | — | 0.015 | 0.01 | — | — | 10 |
| Present Steel 9 | 0.21 | — | 0.1 | — | — | 0.02 | 0.001 | — | 12 |
| Present Steel 10 | 0.1 | 0.3 | — | — | 0.01 | 0.02 | — | 0.01 | 8 |
| Present Steel 11 | 0.2 | 0.1 | — | — | — | — | — | — | 14 |
| Conventional Steel 1 | — | — | — | — | — | — | — | — | 22 |
| Conventional Steel 2 | — | — | — | — | — | — | — | — | 32 |
| Conventional Steel 3 | 0.3 | — | — | — | 0.05 | — | — | — | 138 |
| Conventional Steel 4 | — | — | 0.14 | 0.15 | — | 0.028 | — | — | 27 |
| Conventional Steel 5 | 0.75 | 0.68 | 0.24 | 0.14 | 0.015 | 0.037 | — | — | 25 |
| Conventional Steel 6 | 0.35 | 1.15 | 0.53 | 0.49 | 0.001 | 0.045 | — | — | — |
| Conventional Steel 7 | 0.3 | — | — | — | 0.036 | — | — | | — |
| Conventional Steel 8 | 0.32 | 0.35 | — | — | 0.013 | — | — | — | — |
| Conventional Steel 9 | — | — | 0.21 | 0.19 | 0.025 | 0.035 | — | — | — |
| Conventional | — | 1.09 | 0.51 | 0.36 | 0.021 | 0.021 | — | — | — |

TABLE 7-continued

| | | | | | | | | | |
|---|---|---|---|---|---|---|---|---|---|
| Steel 10 | | | | | | | | | |
| Conventional Steel 11 | — | — | — | — | — | 0.069 | — | — | — |

The conventional steels 1, 2 and 3 are the inventive steels 5, 32, and 55 of Japanese Patent Laid-open Publication No. Hei. 9-194990.

The conventional steels 4, 5, and 6 are the inventive steels 14, 24, and 28 of Japanese Patent Laid-open Publication No. Hei. 10-298708.

The conventional steels 7, 8, 9, and 10 are the inventive steels 48, 58, 60, 61 of Japanese Patent Laid-open Publication No. Hei. 8-60292.

The conventional steel 11 is the inventive steel F of Japanese Paten Laid-open Publication No. Hei. 11-140582.

TABLE 8

| Steel Products | Sample | Primary Deoxidation Order | Dissolved Oxygen Amount after Addition of Al (ppm) | Amount of Ti Added after Deoxidation (%) | Casting Speed (m/min) | Water Spray Amount (l/kg) |
|---|---|---|---|---|---|---|
| PS* 1 | PS 1 | Mn → Si | 19 | 0.014 | 1.1 | 0.32 |
| | PS 2 | Mn → Si | 18 | 0.014 | 1.1 | 0.32 |
| | PS 3 | Mn → Si | 18 | 0.014 | 1.1 | 0.32 |
| | CS 1 | Mn → Si | 32 | 0.014 | 1.1 | 0.32 |
| | CS 2 | Mn → Si | 58 | 0.014 | 1.1 | 0.32 |
| PS* 2 | PS 4 | Mn → Si | 16 | 0.05 | 1.0 | 0.35 |
| PS* 3 | PS 5 | Mn → Si | 15 | 0.015 | 1.0 | 0.35 |
| PS* 4 | PS 6 | Mn → Si | 15 | 0.02 | 1.0 | 0.35 |
| PS* 5 | PS 7 | Mn → Si | 12 | 0.05 | 1.2 | 0.30 |
| PS* 6 | PS 8 | Mn → Si | 17 | 0.02 | 1.2 | 0.30 |
| PS* 7 | PS 9 | Mn → Si | 18 | 0.015 | 1.1 | 0.32 |
| PS* 8 | PS 10 | Mn → Si | 14 | 0.018 | 1.1 | 0.32 |
| PS* 9 | PS 11 | Mn → Si | 19 | 0.02 | 1.1 | 0.32 |
| PS* 10 | PS 12 | Mn → Si | 22 | 0.025 | 1.0 | 0.35 |
| PS* 11 | PS 13 | Mn → Si | 20 | 0.019 | 1.0 | 0.35 |

There is no detailed manufacturing condition for the conventional steels 1 to 11
PS: Present Sample
PS*: Present Steel
CS: Comparative Sample

TABLE 9

| Steel Products | Sample | Heating Temp. (° C.) | Nitrogenizing Atmosphere (l/min) | Heating Time (min) | Rolling Start Temp. (° C.) | Rolling End Temp. (° C.) | TRR (%)/ATRR (%) in Recrystallization Range | Cooling Rate (° C./min) | Nitrogen Content of Matrix (ppm) |
|---|---|---|---|---|---|---|---|---|---|
| PS* 1 | PS 1 | 1220 | 350 | 160 | 1030 | 830 | 55/75 | 5 | 105 |
| | PS 2 | 1190 | 610 | 120 | 1020 | 830 | 55/75 | 5 | 115 |
| | PS 3 | 1150 | 780 | 100 | 1020 | 830 | 55/75 | 5 | 120 |
| | CS 1 | 1050 | 220 | 60 | 1020 | 840 | 55/75 | 5 | 72 |
| | CS 2 | 1300 | 950 | 180 | 1020 | 840 | 55/75 | 5 | 316 |
| PS* 2 | PS 4 | 1180 | 780 | 110 | 1010 | 830 | 55/75 | 6 | 275 |
| PS* 3 | PS 5 | 1200 | 600 | 100 | 1040 | 850 | 55/75 | 7 | 112 |
| PS* 4 | PS 6 | 1170 | 620 | 130 | 1030 | 840 | 55/75 | 7 | 80 |
| PS* 5 | PS 7 | 1190 | 780 | 100 | 1020 | 830 | 55/75 | 6 | 300 |
| PS* 6 | PS 8 | 1200 | 620 | 110 | 1030 | 830 | 55/75 | 6 | 100 |
| PS* 7 | PS 9 | 1150 | 750 | 160 | 1040 | 830 | 60/70 | 6 | 115 |
| PS* 8 | PS 10 | 1180 | 630 | 110 | 1040 | 850 | 60/70 | 5 | 120 |
| PS* 9 | PS 11 | 1200 | 520 | 100 | 1050 | 840 | 60/70 | 8 | 90 |
| PS* 10 | PS 12 | 1210 | 550 | 120 | 1040 | 840 | 60/70 | 7 | 100 |
| PS* 11 | PS 13 | 1230 | 680 | 110 | 1030 | 840 | 60/70 | 8 | 132 |
| Conventional Steel 11 | | 1200 | — | — | $Ar_3$ or more | 960 | | Naturally Cooled | — |

The cooling of each present sample is carried out under the condition in which its cooling rate is controlled, until the temperature of the sample reaches 600° C. corresponding to a ferrite transformation completion temperature. Following this temperature, the present sample is cooled in air.
The conventional steels 1 to 11 are used to manufacture hot-rolled products without any nitrogenizing treatment. There is no detailed hot rolling condition for the conventional steels 1 to 11.
PS: Present Sample; PS*: Present Steel; and CS: Comparative Sample
TRR/ATRR: Thickness Reduction Rate/Accumulated Thickness Reduction Rate in Recrystallization Range

TABLE 10

| | Ratios of Alloying Elements after Nitrogenizing Treatment | | | | | |
|---|---|---|---|---|---|---|
| | Mn/S | Ti/N | N/B | Al/N | V/N | (Ti + 2Al + 4B + V)/N |
| Present Sample 1 | 308 | 1.3 | 15.0 | 3.8 | 1.0 | 10.2 |
| Present Sample 2 | 308 | 1.2 | 16.4 | 3.5 | 0.9 | 9.3 |
| Present Sample 3 | 308 | 1.2 | 17.1 | 3.3 | 0.8 | 8.9 |
| Comparative Sample 1 | 308 | 1.9 | 10.3 | 5.6 | 1.4 | 14.8 |
| Comparative Sample 2 | 308 | 0.4 | 45.1 | 1.3 | 0.3 | 3.4 |
| Present Sample 4 | 300 | 1.8 | 28.0 | 2.5 | 0.4 | 7.3 |
| Present Sample 5 | 221 | 1.4 | 36.7 | 5.5 | 1.8 | 14.2 |
| Present Sample 6 | 296 | 2.5 | 16.0 | 2.5 | 6.3 | 14.0 |
| Present Sample 7 | 380 | 1.7 | 20.0 | 3.0 | 1.7 | 9.5 |
| Present Sample 8 | 300 | 2.0 | 10.0 | 2.5 | 9.0 | 16.4 |
| Present Sample 9 | 227 | 1.3 | 14.4 | 3.5 | 1.7 | 10.3 |
| Present Sample 10 | 220 | 1.5 | 12.0 | 5.0 | 0.8 | 12.7 |
| Present Sample 11 | 300 | 2.2 | 22.5 | 2.8 | 2.2 | 10.2 |
| Present Sample 12 | 242 | 2.5 | 16.7 | 4.5 | 2.0 | 13.7 |
| Present Sample 13 | 368 | 1.4 | 12.0 | 3.6 | — | 8.9 |
| Conventional Steel 1 | 218 | 4.1 | 13.8 | 0.6 | — | 5.7 |
| Conventional Steel 2 | 447 | 2.5 | 96.0 | 0.8 | — | 4.0 |
| Conventional Steel 3 | 480 | 0.8 | 105.8 | 0.4 | — | 1.5 |
| Conventional Steel 4 | 657 | 4.1 | 4.0 | 0.8 | 8.8 | 15.5 |
| Conventional Steel 5 | 440 | 6.5 | 4.0 | 1.1 | 18.5 | 28.1 |
| Conventional Steel 6 | 980 | 3.2 | 2.6 | 0.4 | 16.1 | 21.6 |
| Conventional Steel 7 | 720 | 1.0 | 9.9 | 2.5 | — | 6.5 |
| Conventional Steel 8 | 760 | 1.2 | 14.3 | 0.4 | — | 2.2 |
| Conventional Steel 9 | 655 | 0.8 | 9.1 | 2.1 | 3.9 | 9.2 |
| Conventional Steel 10 | 287 | 0.6 | 9.5 | 3.2 | 1.5 | 8.9 |
| Conventional Steel 11 | 113 | 5.5 | 12.7 | 3.4 | 7.8 | 20.3 |

Test pieces were sampled from the hot-rolled plates manufactured as described above. The sampling was performed at the central portion of each rolled plate in a thickness direction. In particular, test pieces for a tensile test were sampled in a rolling direction, whereas test pieces for a Charpy impact test were sampled in a direction perpendicular to the rolling direction.

Using test pieces sampled as described above, characteristics of precipitates in each steel product (matrix), and mechanical properties of the steel product were measured. The results are described in Table 11. Also, the microstructure and impact toughness of the heat affected zone were measured. The results are described in Table 12. These measurements were carried out in the same fashion as in Example 1.

TABLE 11

| | Characteristics of Precipitates of TiN + MnS | | | Characteristics of Base Metal Structure | | | Mechanical Properties of Matrix | | | | |
|---|---|---|---|---|---|---|---|---|---|---|---|
| Sample | Density (number mm$^2$) | Mean Size (μm) | Spacing (μm) | AGS | FGS | Volume Fraction of Ferrite (%) | Thickness (mm) | Yield Strength (MPa) | Tensile Strength (MPa) | Elongation (%) | Impact Toughness at −40° C. (J) |
| Present Sample 1 | $2.3 \times 10^8$ | 0.016 | 0.26 | 17 | 6 | 82 | 20 | 454 | 573 | 35 | 364 |
| Present Sample 2 | $3.1 \times 10^8$ | 0.017 | 0.26 | 15 | 5 | 84 | 20 | 395 | 581 | 36 | 355 |
| Present Sample 3 | $2.5 \times 10^8$ | 0.012 | 0.24 | 13 | 4 | 83 | 20 | 396 | 580 | 36 | 358 |
| Comparative Sample 1 | $4.3 \times 10^6$ | 0.154 | 1.4 | 38 | 27 | 70 | 20 | 393 | 584 | 28 | 212 |
| Comparative Sample 2 | $5.4 \times 10^6$ | 0.155 | 1.5 | 34 | 23 | 75 | 20 | 392 | 580 | 29 | 189 |
| Present Sample 4 | $3.2 \times 10^8$ | 0.025 | 0.35 | 15 | 6 | 83 | 25 | 396 | 588 | 35 | 358 |
| Present Sample 5 | $2.6 \times 10^8$ | 0.013 | 0.32 | 14 | 6 | 82 | 25 | 396 | 582 | 35 | 349 |
| Present Sample 6 | $3.3 \times 10^8$ | 0.026 | 0.42 | 15 | 6 | 84 | 25 | 390 | 583 | 35 | 358 |
| Present Sample 7 | $4.6 \times 10^8$ | 0.024 | 0.45 | 16 | 5 | 3 | 30 | 390 | 584 | 35 | 346 |

TABLE 11-continued

| Sample | Characteristics of Precipitates of TiN + MnS: Density (number mm$^2$) | Mean Size (μm) | Spacing (μm) | Characteristics of Base Metal Structure: AGS | FGS | Volume Fraction of Ferrite (%) | Mechanical Properties of Matrix: Thickness (mm) | Yield Strength (MPa) | Tensile Strength (MPa) | Elongation (%) | Impact Toughness at −40° C. (J) |
|---|---|---|---|---|---|---|---|---|---|---|---|
| Present Sample 8 | $4.3 \times 10^8$ | 0.014 | 0.35 | 15 | 6 | 82 | 30 | 392 | 582 | 36 | 352 |
| Present Sample 9 | $5.6 \times 10^8$ | 0.028 | 0.36 | 15 | 6 | 81 | 30 | 391 | 586 | 36 | 348 |
| Present Sample 10 | $5.2 \times 10^8$ | 0.021 | 0.35 | 15 | 8 | 82 | 30 | 394 | 586 | 35 | 358 |
| Present Sample 11 | $3.7 \times 10^8$ | 0.029 | 0.29 | 14 | 7 | 84 | 35 | 390 | 596 | 36 | 362 |
| Present Sample 12 | $3.2 \times 10^8$ | 0.025 | 0.25 | 16 | 8 | 83 | 35 | 396 | 582 | 35 | 347 |
| Present Sample 13 | $3.2 \times 10^8$ | 0.024 | 0.34 | 15 | 6 | 87 | 35 | 387 | 568 | 36 | 362 |
| Present Sample 14 | $3.2 \times 10^8$ | 0.025 | 0.35 | 15 | 7 | 89 | 35 | 388 | 559 | 35 | 350 |
| Present Sample 15 | $3.2 \times 10^8$ | 0.023 | 0.36 | 14 | 6 | 81 | 30 | 382 | 562 | 38 | 364 |
| Conventional Steel 1 | | | | | | | 35 | 406 | 436 | — | |
| Conventional Steel 2 | | | | | | | 35 | 405 | 441 | — | |
| Conventional Steel 3 | | | | | | | 25 | 629 | 681 | — | |
| Conventional Steel 4 | Precipitates of MgO—TiN $3.03 \times 10^6$/mm$^2$ | | | | | | 40 | 472 | 609 | 32 | |
| Conventional Steel 5 | Precipitates of MgO—TiN $4.07 \times 10^6$/mm$^2$ | | | | | | 40 | 494 | 622 | 32 | |
| Conventional Steel 6 | Precipitates of MgO—TiN $2.80 \times 10^6$/mm$^2$ | | | | | | 50 | 812 | 912 | 28 | |
| Conventional Steel 7 | | | | | | | 25 | 629 | 681 | — | |
| Conventional Steel 8 | | | | | | | 50 | 504 | 601 | — | |
| Conventional Steel 9 | | | | | | | 60 | 526 | 648 | — | |
| Conventional Steel 10 | | | | | | | 60 | 760 | 829 | — | |
| Conventional Steel 11 | 0.2 μm or less $11.1 \times 10^3$ | | | | | | 50 | 401 | 514 | 18.3 | |

Referring to Table 11, it can be seen that the density of precipitates (complex precipitates of TiN and MnS in each hot-rolled product manufactured in accordance with the present invention is $1.0 \times 10^8$/mm$^2$ or more, whereas the density of precipitates in each conventional product is $4.07 \times 10^5$/mm$^2$ or less. That is, the product of the present invention is formed with precipitates having a very small grain size while being dispersed at a considerably increased density.

The products of the present invention have a matrix structure having fine ferrite at a high fraction of 87% or more.

TABLE 12

| Sample | Grain Size of Austenite in Heat Affected Zone (μm): 1,200 (° C.) | 1,300 (° C.) | 1400 (° C.) | Microstructure of Heat Affected Zone with Heat Input of 100 kJ/cm: Volume Fraction of Ferrite (%) | Mean Grain Size of Ferrite (μm) | Mechanical Properties of Welded Zone, Δ $t_{800-500}$ = 180 sec: Yield Strength (kg/mm$^2$) | Tensile Strength (kg/mm$^2$) | Reproducible Heat Affected Zone Impact Toughness (J) at −40° C. (Maximum Heating Temp. 1,400° C.), Δ $t_{800-500}$ = 120 sec: Impact Toughness (J) | Transition Temp. (° C.) | Δ $t_{800-500}$ = 180 sec: Impact Toughness (J) | Transition Temp. (° C.) |
|---|---|---|---|---|---|---|---|---|---|---|---|
| PS 1 | 23 | 33 | 56 | 73 | 16 | 370 | −74 | 330 | −67 | 294 | −62 |
| PS 2 | 22 | 34 | 55 | 76 | 15 | 383 | −76 | 353 | −69 | 301 | −63 |

TABLE 12-continued

| | Grain Size of Austenite in Heat Affected Zone (μm) | | | Microstructure of Heat Affected Zone with Heat Input of 100 kJ/cm | | Mechanical Properties of Welded Zone | | Reproducible Heat Affected Zone Impact Toughness (J) at −40° C. (Maximum Heating Temp. 1,400° C.) | | | |
|---|---|---|---|---|---|---|---|---|---|---|---|
| | | | | | | Δ $t_{800-500}$ = 180 sec | | Δ $t_{800-500}$ = 120 sec | | Δ $t_{800-500}$ = 180 sec | |
| Sample | 1,200 (° C.) | 1,300 (° C.) | 1400 (° C.) | Volume Fraction of Ferrite (%) | Mean Grain Size of Ferrite (μm) | Yield Strength (kg/mm²) | Tensile Strength (kg/mm²) | Impact Toughness (J) | Transition Temp. (° C.) | Impact Toughness (J) | Transition Temp. (° C.) |
| PS 3 | 23 | 32 | 56 | 74 | 17 | 365 | −72 | 331 | −67 | 298 | −63 |
| CS 1 | 54 | 84 | 182 | 36 | 32 | 126 | −43 | 47 | −34 | 26 | −27 |
| CS 2 | 65 | 91 | 198 | 37 | 35 | 104 | −40 | 35 | −32 | 18 | −26 |
| PS 4 | 25 | 37 | 65 | 75 | 18 | 353 | −71 | 325 | −68 | 287 | −64 |
| PS 5 | 26 | 40 | 57 | 74 | 16 | 362 | −71 | 333 | −67 | 296 | −61 |
| PS 6 | 25 | 31 | 53 | 76 | 17 | 386 | −73 | 353 | −69 | 305 | −62 |
| PS 7 | 24 | 34 | 55 | 74 | 18 | 367 | −71 | 338 | −67 | 293 | −63 |
| PS 8 | 27 | 36 | 53 | 73 | 14 | 364 | −71 | 334 | −67 | 294 | −61 |
| PS 9 | 24 | 36 | 52 | 74 | 17 | 367 | −72 | 335 | −67 | 285 | −62 |
| PS 10 | 22 | 35 | 53 | 73 | 18 | 385 | −72 | 345 | −66 | 294 | −61 |
| PS 11 | 26 | 34 | 64 | 74 | 16 | 358 | −71 | 324 | −68 | 285 | −63 |
| PS 12 | 27 | 38 | 64 | 74 | 18 | 355 | −71 | 324 | −67 | 284 | −62 |
| PS 13 | 24 | 32 | 54 | 75 | 16 | 367 | −72 | 336 | −68 | 285 | −63 |
| PS 14 | 25 | 31 | 58 | 72 | 17 | 365 | −72 | 330 | −68 | 280 | −63 |
| PS 15 | 24 | 32 | 54 | 76 | 14 | 368 | −72 | 345 | −68 | 286 | −63 |
| CS* 1 | | | | | | 187 | −51 | | | | |
| CS* 2 | | | | | | 156 | −48 | | | | |
| CS* 3 | | | | | | 148 | −50 | | | | |
| CS* 4 | | 230 | | 93 | | 143 | −48 | | | 132 (0° C.) | |
| CS* 5 | | 180 | | 87 | | 132 | −45 | | | 129 (0° C.) | |
| CS* 6 | | 250 | | 47 | | 153 | −43 | | | 60 (0° C.) | |
| CS* 7 | | | | | | 141 | −54 | | | | −61 |
| CS* 8 | | | | | | 156 | −59 | | | | −48 |
| CS* 9 | | | | | | 145 | −54 | | | | −42 |
| CS* 10 | | | | | | 138 | −57 | | | | −45 |
| CS* 11 | | | | | | 141 | −43 | 219 (0° C.) | | | |

PS: Present Sample
CS: Comparative Sample
CS*: Conventional Steel

Referring to Table 12, it can be seen that the size of austenite grains under a maximum heating temperature of 1,400° C., as in the heat affected zone, is within a range of 52 to 65 μm in the case of the present invention, whereas the austenite grains in the conventional products are very coarse to have a grain size of about 180 μm. Thus, the steel products of the present invention have a superior effect of suppressing the growth of austenite grains at the heat affected zone in a welding process.

Where a welding process using a heat input of 100 kJ/cm is applied, the steel products of the present invention have a ferrite fraction of about 70% or more.

Under a high heat input welding condition in which a welding heat input is 250 kJ/cm (the time taken for cooling from 800° C. to 500° C. is 180 seconds), the products of the present invention exhibit a superior toughness value of about 280 J or more as a heat affected zone impact toughness at −40° C. while exhibiting about −60° C. as a transition temperature. That is, the products of the present invention exhibit a superior heat affected zone impact toughness under a high heat input welding condition.

Under the same high heat input welding condition, the conventional steel products exhibit a toughness value of about 200 J as a heat affected zone impact toughness at 0° C. while exhibiting about −60° C. as a transition temperature.

What is claimed is:

1. A weldable structural steel product having fine complex precipitates of TiN and MnS, comprising, in terms of percent by weight, 0.03 to 0.17% C, 0.01 to 0.5% Si, 1.0 to 2.5% Mn, 0.005 to 0.2% Ti, 0.0005 to 0.1% Al, 0.008 to 0.030% N, 0.0003 to 0.01% B, 0.001. to 0.2% W, at most 0.03% P, 0.003 to 0.05% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, $6.5 \leqq (Ti+2Al+4B)/N \leqq 14$, and $220 \leqq Mn/S$ 400, and having a microstructure essentially consisting of a complex structure of ferrite and pearlite having a grain size of 20 μm or less and wherein said precipitates of TiN and MnS have a grain size of 0.01 to 0.1 μm and are dispersed at a density of $1.0 \times 10^7/mm^2$ or more with a spacing of 0.5 μm or less.

2. The weldable structural steel product according to claim 1, further comprising 0.01 to 0.2% V while satisfying conditions of $0.3 \leqq V/N \leqq 9$, and $7 \leqq (Ti+2Al+4B+V)/N \leqq 17$.

3. The weldable structural steel product according to claim 1, further comprising one or more selected from a group consisting of Ni: 0.1 to 3.0%, Cu: 0.1 to 1.5%, Nb: 0.01 to 0.1%, Mo: 005 to 1.0%, and Cr: 0.05 to 1.0%.

4. The weldable structural steel product according to claim 1, further comprising one or both of Ca: 0.0005 to 0.005% and REM: 0.005 to 0.05%.

5. The weldable structural steel product according to claim 1, wherein when a toughness difference between the steel product and a heat treated zone, exhibited when the steel product is heated to a temperature of 1,400° C. or more, and then cooled within 60 seconds over a cooling range of from 800° C. to 500° C., is within a range of ±30 J, when a toughness difference between the steel product and the heat treated zone, exhibited when the steel product is heated to a temperature of 1,400° C. or more, and then cooled within 60 to 120 seconds over a cooling range of from 800° C. to 500° C., is within a range of ±40 J, and when a toughness difference between the steel product and the heat treated zone, exhibited when the steel product is heated to a temperature of 1,400° C. or more, and then cooled within 120 to 180 seconds over a cooling range of from 800° C. to 500° C., is within a range of 0 to 100 J.

6. A method for manufacturing a weldable structural steel product having fine complex precipitate of TiN and MnS having a grain size of 0.01 to 0.1 μm dispersed at a density of $1.0 \times 10^7/mm^2$ or more and a spacing of 0.5 μm or less, comprising the steps of:

preparing a steel slab containing, in terms of percent by weight, 0.03 to 0.17% C, 0.01 to 0.5% Si, 1.0 to 2.5% Mn, 0.005 to 0.2% Ti, 0.0005 to 0.1% Al, 0.008 to 0.030% N, 0.0003 to 0.01% B, 0.001 to 0.2% W, at most 0.03% P, 0.003 to 0.05% S, at most 0.005% O, and balance Fe and incidental impurities while satisfying conditions of $1.2 \leqq Ti/N \leqq 2.5$, $10 \leqq N/B \leqq 40$, $2.5 \leqq Al/N \leqq 7$, $6.5 \leqq (Ti+2Al+4B)/N \leqq 14$, and $220 \leqq Mn/S \leqq 400$;

heating the steel slab at a temperature ranging from 1,000° C. to 1,250° C. for 60 to 180 minutes;

hot rolling the heated steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

7. The method according to claim 6, wherein the slab further contains 0.01 to 0.2% V while satisfying conditions of $0.3 \leqq V/N \leqq 9$, and $7 \leqq (Ti+2Al+4B+V)/N \leqq 17$.

8. The method according to claim 6, wherein the slab further contains one or more selected from a group consisting of Ni: 0.1 to 3.0%, Cu: 0.1 to 1.5%, Nb: 0.01 to 0.1%, Mo: 0.05 to 1.0%, and Cr: 0.05 to 1.0%.

9. The method according to claim 6, wherein the slab further contains one or both of Ca: 0.0005 to 0.005% and REM: 0.005 to 0.05%.

10. The method according to claim 6, wherein the preparation of the slab is carried out by adding, to molten steel, a deoxidizing element having a deoxidizing effect higher than that of Ti, thereby controlling the molten steel to have a dissolved oxygen amount of 30 ppm or less, adding, within 10 minutes, Ti to have a content of 0.005 to 0.02%, and casting the resultant slab.

11. The method according to claim 10, wherein the deoxidation is carried out in the order of Mn, Si, and Al.

12. The method according to claim 10, wherein the molten steel is cast at a speed of 0.9 to 1.1 m/min in accordance with continuous casting process while being weak cooled at a secondary cooling zone with a water spray amount of 0.3 to 0.35 l/kg.

13. A method for manufacturing a weldable structural steel product having fine complex precipitates of TiN and MnS having a grain size of 0.01 to 0.1 μm and dispersed at a density of $1.0 \times 10^7/mm^2$ or more and a spacing of 0.5 μm or less, comprising the steps of:

preparing a steel slab containing, in terms of percent by weight, 0.03 to 0.17% C, 0.01 to 0.5% Si, 1.0 to 2.5% Mn, 0.005 to 0.2% Ti, 0.0005 to 0.1% Al, at most 0.005 N, 0.0003 to 0.01% B, 0.001 to 0.2% W, at most 0.003% P, 0.003 to most 0.005 N, 0.0003 to 0.01% B, 0.001 to 0.2% W, at most 0.03P% , 0.003 to 0.05% S, at most 0.005% O, and balance Fe and incidental impurities while satisfying a condition of $220 \leqq Mn/S \leqq 400$;

heating the steel slab at a temperature ranging from 1,000° C. to 1,250° C. for 60 to 180 minutes while nitrogenizing the steel slab to control the N content of the steel slab to be 0.008 to 0.03%, and to satisfy conditions of $1.2 \leqq Ti/N \leqq 2.5$, $10 \leqq N/B \leqq 40$, $2.5 \leqq Al/N \leqq 7$, and $6.5 \leqq (Ti+2Al+4B)/N \leqq 14$;

hot rolling the nitrogenized steel slab in an austenite recrystallization range at a thickness reduction rate of 40% or more; and cooling the hot-rolled steel slab at a rate of 1° C./min to a temperature corresponding to ±10° C. from a ferrite transformation finish temperature.

14. The method according to claim 13, wherein the slab further contains 0.01 to 0.2% V while satisfying conditions of $0.3 \leqq V/N \leqq 9$, and $7 \leqq (Ti+2Al+4B+V)/N \leqq 17$.

15. The method according to claim 13, wherein the slab further contains one or more selected from a group consisting of Ni: 0.1 to 3.0%, Nb: 0.01 to 0.1%, Mo: 0.05 to 1.0%, and Cr: 0.05 to 1.0%.

16. The method according to claim 13, wherein the slab further contains one or both of Ca: 0.0005 to 0.005% and REM: 0.005 to 0.05%.

17. The method according to claim 13, wherein the preparation of the slab is carried out by adding, to molten steel, a deoxidizing element having a deoxidizing effect higher than that of Ti, thereby deoxidizing the molten steel to have a dissolved oxygen amount of 30 ppm or less, adding, within 10 minutes, Ti to have a content of 0.005 to 0.02%, and casting the resultant slab.

18. The method according to claim 17, wherein the deoxidation is carried out in the order of Mn, Si, and Al.

19. A welded structure having a superior heat affected zone toughness, manufactured using a weldable structural steel product according to claim 1.

* * * * *

UNITED STATES PATENT AND TRADEMARK OFFICE

CERTIFICATE OF CORRECTION

PATENT NO. : 6,946,038 B2
APPLICATION NO. : 10/182365
DATED : September 20, 2005
INVENTOR(S) : Jeong et al.

It is certified that error appears in the above-identified patent and that said Letters Patent is hereby corrected as shown below:

Title Page [54] The Title should read: -- STEEL PLATE HAVING TIN+MNS PRECIPITATES FOR WELDED STRUCTURES, METHOD FOR MANUFACTURING SAME AND WELDED STRUCTURE MADE THEREFROM --.

Title Page, insert -- (*) Notice:
The term of this patent shall not extend beyond the expiration date of U.S. Patent No. 6,686,061. --

Column 3, Line 2, "welding welded structural steel" should read -- welded structural steel --

Column 39, Line 4, Claim 1, "Mn/S 400" should read -- Mn/S $\leq$400 --

Column 40, Line 25, Claim 13, "0.003% P" should read -- 0.03% P --

Column 40, Claim 13, delete the following text beginning at Line 25 and ending on Line 26:
"most 0.005 N, 0.0003 to 0.01% B, 0.001 to 0.2% W, at most 0.03P%, 0.003 to"

Signed and Sealed this

Twenty-sixth Day of December, 2006

JON W. DUDAS
*Director of the United States Patent and Trademark Office*